US010356544B2

(12) United States Patent
Zhang et al.

(10) Patent No.: US 10,356,544 B2
(45) Date of Patent: Jul. 16, 2019

(54) METHOD FOR PROCESSING SOUND SIGNAL AND TERMINAL DEVICE

(71) Applicant: Huawei Technologies Co., Ltd., Shenzhen (CN)

(72) Inventors: Qi Zhang, Shenzhen (CN); Na Qi, Beijing (CN); Tizheng Wang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/656,465

(22) Filed: Jul. 21, 2017

(65) Prior Publication Data

US 2017/0325046 A1 Nov. 9, 2017

Related U.S. Application Data

(63) Continuation of application No. PCT/CN2015/086933, filed on Aug. 14, 2015.

(30) Foreign Application Priority Data

Jan. 21, 2015 (CN) ..... 2015 1 0030723

(51) Int. Cl.
*H04S 1/00* (2006.01)
*H04S 3/00* (2006.01)
(Continued)

(52) U.S. Cl.
CPC ..... *H04S 7/303* (2013.01); *H04S 1/005* (2013.01); *H04S 3/008* (2013.01); *H04R 5/027* (2013.01);
(Continued)

(58) Field of Classification Search
CPC ..... H04S 7/303; H04S 3/008; H04S 1/005; H04S 5/00; H04S 2400/15;
(Continued)

(56) References Cited

U.S. PATENT DOCUMENTS

2002/0048376 A1* 4/2002 Ukita ..... H04N 7/15 381/92
2005/0089181 A1 4/2005 Polk, Jr.
(Continued)

FOREIGN PATENT DOCUMENTS

CN 1875656 A 12/2006
CN 101263739 A 9/2008
(Continued)

OTHER PUBLICATIONS

Chen, Fang; "Localization of 3-D Sound Presented through Headphone-Duration of Sound Presentation and Localization Accuracy," XP-001046097, Journal of the Audio Engineering Society, Dec. 2003, 9 pages, vol. 12, New York, NY.
(Continued)

*Primary Examiner* — Yogeshkumar Patel
(74) *Attorney, Agent, or Firm* — Slater Matsil, LLP

(57) ABSTRACT

A method includes: receiving, by using channels located in different positions of a terminal device, at least three signals emit by a same sound source; determining, according to three signals in the at least three signals, a signal delay difference between every two of the three signals; determining, according to the signal delay difference, the position of the sound source relative to the terminal device; and when the sound source is located in front of the terminal device, performing orientation enhancement processing on a target signal in the at least three signals, and obtaining a first output signal and a second output signal of the terminal device according to a result of the orientation enhancement processing, where the orientation enhancement processing is used to increase a degree of discrimination between a front characteristic frequency band and a rear characteristic frequency band of the target signal.

16 Claims, 8 Drawing Sheets

(51) Int. Cl.

| | |
|---|---|
| ***H04S 7/00*** | (2006.01) |
| ***H04R 5/027*** | (2006.01) |
| ***H04R 5/033*** | (2006.01) |

(52) U.S. Cl.
CPC ..... *H04R 5/033* (2013.01); *H04S 2400/01* (2013.01); *H04S 2400/11* (2013.01); *H04S 2400/15* (2013.01); *H04S 2420/01* (2013.01); *H04S 2420/07* (2013.01)

(58) Field of Classification Search
CPC ..... H04S 2400/01; H04S 2400/11; H04S 2420/01; H04S 2420/03; H04S 2420/07; H04S 7/302; H04S 7/304; H04S 7/305; H04S 3/004; H04R 3/005; H04R 1/406; H04R 5/027; H04R 5/033; H04R 2499/11; H04R 2430/20; H04R 29/005; H04R 25/407
USPC ..... 381/303, 26, 74
See application file for complete search history.

(56) References Cited

U.S. PATENT DOCUMENTS

| | | | | |
|---|---|---|---|---|
| 2010/0226500 | A1 | 9/2010 | Wang | |
| 2012/0014528 | A1* | 1/2012 | Wang | H04R 25/407 381/17 |
| 2012/0101610 | A1 | 4/2012 | Ojala et al. | |
| 2012/0128174 | A1* | 5/2012 | Tammi | H04S 1/002 381/92 |

FOREIGN PATENT DOCUMENTS

| | | | |
|---|---|---|---|
| CN | 101884227 | A | 11/2010 |
| CN | 102804808 | A | 11/2012 |
| CN | 104735588 | A | 6/2014 |
| EP | 1862813 | A1 | 12/2007 |
| WO | 2004016037 | A1 | 2/2004 |

OTHER PUBLICATIONS

So, R.H.Y. et al., Effects of Spectral Manipulation on Non-Individualized Head-Related Transfer Functions (HRTFs), 2011, pp. 1-27.

* cited by examiner

METHOD FOR PROCESSING SOUND SIGNAL AND TERMINAL DEVICE

CROSS-REFERENCE TO RELATED APPLICATIONS

This application is a continuation of International Application No. PCT/CN2015/086933, filed on Aug. 14, 2015, which claims priority to Chinese Patent Application No. 201510030723.0, filed on Jan. 21, 2015. The disclosures of the aforementioned applications are hereby incorporated by reference in their entireties.

TECHNICAL FIELD

The present invention relates to the field of terminal devices, and more specifically, to a method for processing a sound signal and a terminal device.

BACKGROUND

As audio technologies are booming, people have higher requirements on spatial attributes of sound while seeking 3D visual experience. A more realistic immersive experience effect can be generated by combining a video with an audio in a terminal device. In current application, a most common terminal device playback device is a head-mounted terminal device. Miniature microphones are placed at two earpieces of the head-mounted terminal device to collect binaural sound signals. After the collected binaural sound signals undergo processes of amplification, transmission, recording, and the like, sound is played back by using the earpieces of the head-mounted terminal device. Therefore, main spatial information consistent with that of an original sound field is generated at two ears of a listener, and playback of the spatial information of the sound is implemented. A spatial auditory effect generated by a virtual auditory playback system based on binaural sound signals is more realistic and natural.

However, when the earpieces of the head-mounted terminal device are used to play back binaural sound signals, because an earpiece playback manner is different from that of the original sound field, cognition information for determining a front/rear orientation is lost, and a problem of front/rear sound image confusion occurs. A case of sound image confusion occurs because in various factors for determining a direction of a sound source, an interaural time difference (ITD) and an interaural level difference (ILD) can determine a cone of confusion of the sound source only, but cannot determine the direction of the sound source. Due to the problem of front/rear sound image confusion, the listener may determine a front sound image as a rear sound image, or determine a rear sound image as a front sound image. In addition, a probability of incorrectly determining a front sound image as a rear sound image is far greater than a probability of incorrectly determining a rear sound image as a front sound image. Therefore, a problem urgently to be resolved is how to improve a problem of incorrectly determining a front sound image as a rear sound image during sound playback of the terminal device.

SUMMARY

Embodiments of the present invention provide a method for processing a sound signal and a terminal device, to improve a problem of incorrectly determining a front sound image as a rear sound image during sound playback of a terminal device.

According to a first aspect, a method for processing a sound signal is provided. The method includes receiving, by using channels located in different positions of a terminal device, at least three signals emit by a same sound source, where the at least three signals are in a one-to-one correspondence to the channels. The method also includes determining, according to three signals in the at least three signals, a signal delay difference between every two of the three signals, where a position of the sound source relative to the terminal device can be determined according to the signal delay difference. The method also includes determining, according to the signal delay difference, the position of the sound source relative to the terminal device. The method also includes, when the sound source is located in front of the terminal device, performing orientation enhancement processing on a target signal in the at least three signals, and obtaining a first output signal and a second output signal of the terminal device according to a result of the orientation enhancement processing, where the orientation enhancement processing is used to increase a degree of discrimination between a front characteristic frequency band and a rear characteristic frequency band of the target signal.

With reference to the first aspect, in a first possible implementation of the first aspect, the at least three signals include a first signal received on a first channel, a second signal received on a second channel, and a third signal received on a third channel, the first channel is closer to the front than the second channel and the third channel, and the first channel is located between the second channel and the third channel; the performing orientation enhancement processing on a target signal in the at least three signals is specifically: when the first signal is the target signal, performing the orientation enhancement processing on the first signal to obtain a first processed signal; and in this case, the obtaining a first output signal and a second output signal of the terminal device according to a result of the orientation enhancement processing is specifically: obtaining the first output signal according to the first processed signal and the second signal; and obtaining the second output signal according to the first processed signal and the third signal.

With reference to the first aspect, in a second possible implementation of the first aspect, the at least three signals include a first signal received on a first channel, a second signal received on a second channel, and a third signal received on a third channel, the first channel is closer to the front than the second channel and the third channel, and the first channel is located between the second channel and the third channel; the performing orientation enhancement processing on a target signal in the at least three signals is specifically: when all the first signal, the second signal, and the third signal are the target signals, performing the orientation enhancement processing on the first signal to obtain a first processed signal, performing the orientation enhancement processing on the second signal to obtain a second processed signal, and performing the orientation enhancement processing on the third signal to obtain a third processed signal; and in this case, the obtaining a first output signal and a second output signal of the terminal device according to a result of the orientation enhancement processing is specifically: obtaining the first output signal according to the first processed signal and the second processed signal; and obtaining the second output signal according to the first processed signal and the third processed signal.

With reference to the first aspect, in a third possible implementation of the first aspect, the at least three signals include a first signal received on a first channel, a second signal received on a second channel, and a third signal received on a third channel, the first channel is closer to the front than the second channel and the third channel, and the first channel is located between the second channel and the third channel; the performing orientation enhancement processing on a target signal in the at least three signals is specifically: when all the first signal, the second signal, and the third signal are the target signals, performing the orientation enhancement processing on the first signal to obtain a first processed signal, performing the orientation enhancement processing on the second signal to obtain a second processed signal, and performing the orientation enhancement processing on the third signal to obtain a third processed signal; and in this case, the obtaining a first output signal and a second output signal of the terminal device according to a result of the orientation enhancement processing is specifically: obtaining the first output signal according to the first processed signal, the second processed signal, and the second signal; and obtaining the second output signal according to the first processed signal, the third processed signal, and the third signal.

With reference to anyone of the first to the third possible implementations of the first aspect, in a fourth possible implementation of the first aspect, performing, according to a signal amplitude in each characteristic frequency band of the second signal and a signal amplitude in each characteristic frequency band of the third signal, an amplitude adjustment on each characteristic frequency band corresponding to the first processed signal, so as to obtain the first output signal and the second output signal, where the first processed signal, the second signal, and the third signal are divided into the characteristic frequency bands in a same manner.

With reference to the first aspect, in a fifth possible implementation of the first aspect, the at least three signals include a first type of signal received on a first type of channel, a second signal received on a second channel, and a third signal received on a third channel, the first type of channel includes at least two channels, the at least two channels are respectively used to receive at least two signals, any channel in the first type of channel is closer to the front than the second channel and the third channel, and any channel in the first type of channel is located between the second channel and the third channel; the performing orientation enhancement processing on a target signal in the at least three signals is specifically: when at least one signal in the first type of signal is the target signal, performing the orientation enhancement processing on the at least one signal in the first type of signal to obtain a first type of processed signal; and in this case, the obtaining a first output signal and a second output signal of the terminal device according to a result of the orientation enhancement processing is specifically: obtaining the first output signal according to the first type of processed signal and the second signal; and obtaining the second output signal according to the first type of processed signal and the third signal.

With reference to the first aspect, in a sixth possible implementation of the first aspect, the at least three signals include a first type of signal received on a first type of channel, a second signal received on a second channel, and a third signal received on a third channel, the first type of channel includes at least two channels, the at least two channels are respectively used to receive at least two signals, any channel in the first type of channel is closer to the front than the second channel and the third channel, and any channel in the first type of channel is located between the second channel and the third channel; the performing orientation enhancement processing on a target signal in the at least three signals is specifically: when at least one signal in the first type of signal, the second signal, and the third signal are the target signals, performing the orientation enhancement processing on the at least one signal in the first type of signal to obtain a first type of processed signal, performing the orientation enhancement processing on the second signal to obtain a second processed signal, and performing the orientation enhancement processing on the third signal to obtain a third processed signal; and in this case, the obtaining a first output signal and a second output signal of the terminal device according to a result of the orientation enhancement processing is specifically: obtaining the first output signal according to the first type of processed signal and the second processed signal; and obtaining the second output signal according to the first type of processed signal and the third processed signal.

With reference to the first aspect, in a seventh possible implementation of the first aspect, the at least three signals include a first type of signal received on a first type of channel, a second signal received on a second channel, and a third signal received on a third channel, the first type of channel includes at least two channels, the at least two channels are respectively used to receive at least two signals, any channel in the first type of channel is closer to the front than the second channel and the third channel, and any channel in the first type of channel is located between the second channel and the third channel; the performing orientation enhancement processing on a target signal in the at least three signals is specifically: when at least one signal in the first type of signal, the second signal, and the third signal are the target signals, performing the orientation enhancement processing on the at least one signal in the first type of signal to obtain a first type of processed signal, performing the orientation enhancement processing on the second signal to obtain a second processed signal, and performing the orientation enhancement processing on the third signal to obtain a third processed signal; and in this case, the obtaining a first output signal and a second output signal of the terminal device according to a result of the orientation enhancement processing is specifically: obtaining the first output signal according to the first type of processed signal, the second processed signal, and the second signal; and obtaining the second output signal according to the first type of processed signal, the third processed signal, and the third signal.

With reference to the first aspect, in an eighth possible implementation of the first aspect, the at least three signals include a first signal received on a first channel, a second signal received on a second channel, a third signal received on a third channel, a fourth signal received on a fourth channel, and a fifth signal received on a fifth channel, the first channel, the second channel, or the third channel is closer to the front than the fourth channel and the fifth channel, the first channel, the second channel, and the third channel are located between the fourth channel and the fifth channel, and the front of the terminal device is divided into a first interval, a second interval, and a third interval that are adjacent; the performing orientation enhancement processing on a target signal in the at least three signals is specifically: when the sound source is located in the first interval and the first signal is the target signal, performing the orientation enhancement processing on the first signal to obtain a first processed signal; when the sound source is located in the second interval and the second signal is the target signal, performing the orientation enhancement processing on the second signal to obtain a second processed signal; or when the sound source is located in the third interval and the third signal is the target signal, performing the orientation enhancement processing on the third signal to obtain a third processed signal; and in this case, the obtaining a first output signal and a second output signal of the terminal device according to a result of the orientation enhancement processing is specifically: when the sound source is located in the first interval, obtaining the first output signal according to the first processed signal and the fourth signal, and obtaining the second output signal according to the first processed signal and the fifth signal; when the sound source is located in the second interval, obtaining the first output signal according to the second processed signal and the fourth signal, and obtaining the second output signal according to the second processed signal and the fifth signal; or when the sound source is located in the third interval, obtaining the first output signal according to the third processed signal and the fourth signal, and obtaining the second output signal according to the third processed signal and the fifth signal.

With reference to the first aspect, in a ninth possible implementation of the first aspect, the at least three signals include a first signal received on a first channel, a second signal received on a second channel, a third signal received on a third channel, a fourth signal received on a fourth channel, and a fifth signal received on a fifth channel, the first channel, the second channel, or the third channel is closer to the front than the fourth channel and the fifth channel, the first channel, the second channel, and the third channel are located between the fourth channel and the fifth channel, and the front of the terminal device is divided into a first interval, a second interval, and a third interval that are adjacent; the performing orientation enhancement processing on a target signal in the at least three signals is specifically: when the sound source is located in the first interval, and all the first signal, the fourth signal, and the fifth signal are the target signals, performing the orientation enhancement processing on the first signal to obtain a first processed signal, performing the orientation enhancement processing on the fourth signal to obtain a fourth processed signal, and performing the orientation enhancement processing on the fifth signal to obtain a fifth processed signal; when the sound source is located in the second interval, and all the second signal, the fourth signal, and the fifth signal are the target signals, performing the orientation enhancement processing on the second signal to obtain a second processed signal, performing the orientation enhancement processing on the fourth signal to obtain a fourth processed signal, and performing the orientation enhancement processing on the fifth signal to obtain a fifth processed signal; or when the sound source is located in the third interval, and all the third signal, the fourth signal, and the fifth signal are the target signals, performing the orientation enhancement processing on the third signal to obtain a third processed signal, performing the orientation enhancement processing on the fourth signal to obtain a fourth processed signal, and performing the orientation enhancement processing on the fifth signal to obtain a fifth processed signal; and in this case, the obtaining a first output signal and a second output signal of the terminal device according to a result of the orientation enhancement processing is specifically: when the sound source is located in the first interval, obtaining the first output signal according to the fourth processed signal and the first processed signal, and obtaining the second output signal according to the fifth processed signal and the first processed signal; when the sound source is located in the second interval, obtaining the first output signal according to the fourth processed signal and the second processed signal, and obtaining the second output signal according to the fifth processed signal and the second processed signal; or when the sound source is located in the third interval, obtaining the first output signal according to the fourth processed signal and the third processed signal, and obtaining the second output signal according to the fifth processed signal and the third processed signal.

With reference to the eighth or the ninth possible implementation of the first aspect, in a tenth possible implementation of the first aspect, when the sound source is located in the first interval, the method further includes: performing, according to a signal amplitude in each characteristic frequency band of the fourth signal and a signal amplitude in each characteristic frequency band of the fifth signal, an amplitude adjustment on each characteristic frequency band corresponding to the first processed signal, so as to obtain the first output signal and the second output signal; when the sound source is located in the second interval, performing, according to a signal amplitude in each characteristic frequency band of the fourth signal and a signal amplitude in each characteristic frequency band of the fifth signal, an amplitude adjustment on each characteristic frequency band corresponding to the second processed signal, so as to obtain the first output signal and the second output signal; or when the sound source is located in the third interval, performing, according to a signal amplitude in each characteristic frequency band of the fourth signal and a signal amplitude in each characteristic frequency band of the fifth signal, an amplitude adjustment on each characteristic frequency band corresponding to the third processed signal, so as to obtain the first output signal and the second output signal; where the first processed signal, the second processed signal, the third processed signal, the fourth signal, and the fifth signal are divided into the characteristic frequency bands in a same manner.

According to a second aspect, a terminal device is provided. The terminal device includes a receiving module, where the receiving module includes at least three receiving channels located in different positions of the terminal device, and the at least three receiving channels are used to receive at least three signals emit by a same sound source, where the at least three signals are in a one-to-one correspondence to the channels. The terminal device also includes a determining module, configured to determine, according to three signals in the at least three signals received by the receiving module, a signal delay difference between every two of the three signals, where a position of the sound source relative to the terminal device can be determined according to the signal delay difference. The terminal device also includes a judging module, configured to determine, according to the signal delay difference obtained by the determining module, the position of the sound source relative to the terminal device. The terminal device also includes a processing module, configured to: when the judging module determines that the sound source is located in front of the terminal device, perform orientation enhancement processing on a target signal in the at least three signals, and obtain a first output signal and a second output signal of the terminal device according to a result of the orientation enhancement processing, where the orientation enhancement processing is used to increase a degree of discrimination between a front characteristic frequency band and a rear characteristic frequency band of the target signal.

With reference to the second aspect, in a first possible implementation of the second aspect, the receiving module includes a first channel, a second channel, and a third channel, the at least three signals include a first signal received on the first channel, a second signal received on the second channel, and a third signal received on the third channel, the first channel is closer to the front than the second channel and the third channel, and the first channel is located between the second channel and the third channel; the processing module includes a first processing unit and a second processing unit, and when the judging module determines that the sound source is located in front of the terminal device, the first processing unit is configured to perform the orientation enhancement processing on the first signal to obtain a first processed signal, where the first signal is the target signal; and the second processing unit is configured to obtain the first output signal according to the second signal and the first processed signal that is obtained by the first processing unit, and obtain the second output signal according to the third signal and the first processed signal that is obtained by the first processing unit.

With reference to the second aspect, in a second possible implementation of the second aspect, the receiving module includes a first channel, a second channel, and a third channel, the at least three signals include a first signal received on the first channel, a second signal received on the second channel, and a third signal received on the third channel, the first channel is closer to the front than the second channel and the third channel, and the first channel is located between the second channel and the third channel; the processing module includes a first processing unit and a second processing unit, and when the judging module determines that the sound source is located in front of the terminal device, the first processing unit is configured to perform the orientation enhancement processing on the first signal to obtain a first processed signal, perform the orientation enhancement processing on the second signal to obtain a second processed signal, and perform the orientation enhancement processing on the third signal to obtain a third processed signal, where all the first signal, the second signal, and the third signal are the target signals; and the second processing unit is configured to obtain the first output signal according to the first processed signal and the second processed signal that are obtained by the first processing unit, and obtain the second output signal according to the first processed signal and the third processed signal that are obtained by the first processing unit.

With reference to the second aspect, in a third possible implementation of the second aspect, the receiving module includes a first channel, a second channel, and a third channel, the at least three signals include a first signal received on the first channel, a second signal received on the second channel, and a third signal received on the third channel, the first channel is closer to the front than the second channel and the third channel, and the first channel is located between the second channel and the third channel; the processing module includes a first processing unit and a second processing unit, and when the judging module determines that the sound source is located in front of the terminal device, the first processing unit is configured to perform the orientation enhancement processing on the first signal to obtain a first processed signal, perform the orientation enhancement processing on the second signal to obtain a second processed signal, and perform the orientation enhancement processing on the third signal to obtain a third processed signal, where all the first signal, the second signal, and the third signal are the target signals; and the second processing unit is configured to obtain the first output signal according to the second signal, the first processed signal that is obtained by the first processing unit, and the second processed signal that is obtained by the first processing unit, and obtain the second output signal according to the third signal, the first processed signal that is obtained by the first processing unit, and the third processed signal that is obtained by the first processing unit.

With reference to the first to the third possible implementations of the second aspect, in a fourth possible implementation of the second aspect, the processing module further includes a third processing unit, and the third processing unit is configured to perform, according to a signal amplitude in each characteristic frequency band of the second signal and a signal amplitude in each characteristic frequency band of the third signal, an amplitude adjustment on each characteristic frequency band corresponding to the first processed signal obtained by the first processing unit, so as to obtain the first output signal and the second output signal, where the first processed signal, the second signal, and the third signal are divided into the characteristic frequency bands in a same manner.

With reference to the second aspect, in a fifth possible implementation of the second aspect, the receiving module includes a first type of channel, a second channel, and a third channel, the at least three signals include a first type of signal received on the first channel, a second signal received on the second channel, and a third signal received on the third channel, the first type of channel includes at least two channels, the at least two channels are respectively used to receive at least two signals, any channel in the first type of channel is closer to the front than the second channel and the third channel, and any channel in any channel in the first type of channel is located between the second channel and the third channel; the processing module includes a first processing unit and a second processing unit, and when the judging module determines that the sound source is located in front of the terminal device, the first processing unit is configured to perform the orientation enhancement processing on at least one signal in the first type of signal to obtain a first type of processed signal, perform the orientation enhancement processing on the second signal to obtain a second processed signal, and perform the orientation enhancement processing on the third signal to obtain a third processed signal, where the at least one signal in the first type of signal is the target signal; and the second processing unit is configured to obtain the first output signal according to the second signal and the first type of processed signal that is obtained by the first processing unit, and obtain the second output signal according to the third signal and the first type of processed signal that is obtained by the first processing unit.

With reference to the second aspect, in a sixth possible implementation of the second aspect, the receiving module includes a first type of channel, a second channel, and a third channel, the at least three signals include a first type of signal received on the first channel, a second signal received on the second channel, and a third signal received on the third channel, the first type of channel includes at least two channels, the at least two channels are respectively used to receive at least two signals, any channel in the first type of channel is closer to the front than the second channel and the third channel, and any channel in the first type of channel is located between the second channel and the third channel; the processing module includes a first processing unit and a second processing unit, and when the judging module determines that the sound source is located in front of the terminal device, the first processing unit is configured to perform the orientation enhancement processing on at least one signal in the first type of signal to obtain a first type of processed signal, perform the orientation enhancement processing on the second signal to obtain a second processed signal, and perform the orientation enhancement processing on the third signal to obtain a third processed signal, where the at least one signal in the first type of signal, the second signal, and the third signal are the target signals; and the second processing unit is configured to obtain the first output signal according to the first type of processed signal that is obtained by the first processing unit and the second processed signal that is obtained by the first processing unit, and obtain the second output signal according to the first type of processed signal that is obtained by the first processing unit and the third processed signal that is obtained by the first processing unit.

With reference to the second aspect, in a seventh possible implementation of the second aspect, the receiving module includes a first type of channel, a second channel, and a third channel, the at least three signals include a first type of signal received on the first channel, a second signal received on the second channel, and a third signal received on the third channel, the first type of channel includes at least two channels, the at least two channels are respectively used to receive at least two signals, any channel in the first type of channel is closer to the front than the second channel and the third channel, and any channel in the first type of channel is located between the second channel and the third channel; the processing module includes a first processing unit and a second processing unit, and when the judging module determines that the sound source is located in front of the terminal device, the first processing unit is configured to perform the orientation enhancement processing on at least one signal in the first type of signal to obtain a first type of processed signal, perform the orientation enhancement processing on the second signal to obtain a second processed signal, and perform the orientation enhancement processing on the third signal to obtain a third processed signal, where the at least one signal in the first type of signal, the second signal, and the third signal are the target signals; and the second processing unit is configured to obtain the first output signal according to the second signal, the first type of processed signal that is obtained by the first processing unit, and the second processed signal that is obtained by the first processing unit, and obtain the second output signal according to the third signal, the first type of processed signal that is obtained by the first processing unit, and the third processed signal that is obtained by the first processing unit.

With reference to the second aspect, in an eighth possible implementation of the second aspect, the receiving module includes a first channel, a second channel, a third channel, a fourth channel, and a fifth channel, the at least three signals include a first signal received on the first channel, a second signal received on the second channel, a third signal received on the third channel, a fourth signal received on the fourth channel, and a fifth signal received on the fifth channel, the first channel, the second channel, or the third channel is closer to the front than the fourth channel and the fifth channel, the first channel, the second channel, and the third channel are located between the fourth channel and the fifth channel, and the front of the terminal device is divided into a first interval, a second interval, and a third interval that are adjacent; the processing module includes a first processing unit and a second processing unit, and when the judging module determines that the sound source is located in the first interval and the first signal is the target signal, the first processing unit is configured to perform the orientation enhancement processing on the first signal to obtain a first processed signal; when the judging module determines that the sound source is located in the second interval of the terminal device and the second signal is the target signal, the first processing unit is configured to perform the orientation enhancement processing on the second signal to obtain a second processed signal; or when the judging module determines that the sound source is located in the third interval of the terminal device and the third signal is the target signal, the first processing unit is configured to perform the orientation enhancement processing on the third signal to obtain a third processed signal; and when the judging module determines that the sound source is located in the first interval, the second processing unit is configured to obtain the first output signal according to the fourth signal and the first processed signal that is obtained by the first processing unit, and obtain the second output signal according to the fifth signal and the first processed signal that is obtained by the first processing unit; when the judging module determines that the sound source is located in the second interval, the second processing unit is configured to obtain the first output signal according to the fourth signal and the second processed signal that is obtained by the first processing unit, and obtain the second output signal according to the fifth signal and the second processed signal that is obtained by the first processing unit; or when the judging module determines that the sound source is located in the third interval, the second processing unit is specifically configured to obtain the first output signal according to the fourth signal and the third processed signal that is obtained by the first processing unit, and obtain the second output signal according to the fifth signal and the third processed signal that is obtained by the first processing unit.

With reference to the second aspect, in a ninth possible implementation of the second aspect, the receiving module includes a first channel, a second channel, a third channel, a fourth channel, and a fifth channel, the at least three signals include a first signal received on the first channel, a second signal received on the second channel, a third signal received on the third channel, a fourth signal received on the fourth channel, and a fifth signal received on the fifth channel, the first channel, the second channel, or the third channel is closer to the front than the fourth channel and the fifth channel, the first channel, the second channel, and the third channel are located between the fourth channel and the fifth channel, and the front of the terminal device is divided into a first interval, a second interval, and a third interval that are adjacent; the processing module includes a first processing unit and a second processing unit, and when the judging module determines that the sound source is located in the first interval and the first signal is the target signal, the first processing unit is configured to perform the orientation enhancement processing on the first signal to obtain a first processed signal, perform the orientation enhancement processing on the fourth signal to obtain a fourth processed signal, and perform the orientation enhancement processing on the fifth signal to obtain a fifth processed signal; when the judging module determines that the sound source is located in the second interval of the terminal device and the second signal is the target signal, the first processing unit is configured to perform the orientation enhancement processing on the second signal to obtain a second processed signal, perform the orientation enhancement processing on the fourth signal to obtain a fourth processed signal, and perform the orientation enhancement processing on the fifth signal to obtain a fifth processed signal; or when the judging module determines that the sound source is located in the third interval of the terminal device and the third signal is the target signal, the first processing unit is configured to perform the orientation enhancement processing on the third signal to obtain a third processed signal, perform the orientation enhancement processing on the fourth signal to obtain a fourth processed signal, and perform the orientation enhancement processing on the fifth signal to obtain a fifth processed signal; and when the judging module determines that the sound source is located in the first interval, the second processing unit is configured to obtain the first output signal according to the fourth processed signal that is obtained by the first processing unit and the first processed signal that is obtained by the first processing unit, and obtain the second output signal according to the fifth processed signal that is obtained by the first processing unit and the first processed signal that is obtained by the first processing unit; when the judging module determines that the sound source is located in the second interval, the second processing unit is configured to obtain the first output signal according to the fourth processed signal that is obtained by the first processing unit and the second processed signal that is obtained by the first processing unit, and obtain the second output signal according to the fifth processed signal that is obtained by the first processing unit and the second processed signal that is obtained by the first processing unit; or when the judging module determines that the sound source is located in the third interval, the second processing unit is configured to obtain the first output signal according to the fourth processed signal and the third processed signal that are obtained by the first processing unit, and obtain the second output signal according to the fifth processed signal that is obtained by the first processing unit and the third processed signal that is obtained by the first processing unit.

With reference to the eighth or the ninth possible implementation of the second aspect, in a tenth possible implementation of the second aspect, the processing module further includes a third processing unit, and the third processing unit is specifically configured to: when the judging module determines that the sound source is located in the first interval, perform, according to a signal amplitude in each characteristic frequency band of the fourth signal and a signal amplitude in each characteristic frequency band of the fifth signal, an amplitude adjustment on each characteristic frequency band corresponding to the first processed signal obtained by the first processing unit, so as to obtain the first output signal and the second output signal; when the judging module determines that the sound source is located in the second interval, perform, according to a signal amplitude in each characteristic frequency band of the fourth signal and a signal amplitude in each characteristic frequency band of the fifth signal, an amplitude adjustment on each characteristic frequency band corresponding to the second processed signal obtained by the first processing unit, so as to obtain the first output signal and the second output signal; or when the judging module determines that the sound source is located in the third interval, perform, according to a signal amplitude in each characteristic frequency band of the fourth signal and a signal amplitude in each characteristic frequency band of the fifth signal, an amplitude adjustment on each characteristic frequency band corresponding to the third processed signal obtained by the first processing unit, so as to obtain the first output signal and the second output signal; where the first processed signal, the second processed signal, the third processed signal, the fourth signal, and the fifth signal are divided into the characteristic frequency bands in a same manner.

In the embodiments of the present invention, a position of a sound source relative to a terminal device is determined, orientation enhancement processing is performed on a target signal emit by the sound source, and an output signal of the terminal device is obtained according to a result of the orientation enhancement processing, so that a degree of discrimination between a front characteristic frequency band and a rear characteristic frequency band of the output signal is increased. Therefore, perception of a sound image orientation of an output signal can be enhanced, and a probability of incorrectly determining a front sound image as a rear sound image is reduced.

BRIEF DESCRIPTION OF THE DRAWINGS

To describe the technical solutions in the embodiments of the present invention more clearly, the following briefly describes the accompanying drawings required for describing the embodiments of the present invention. Apparently, the accompanying drawings in the following description show merely some embodiments of the present invention, and a person of ordinary skill in the art may still derive other drawings from these accompanying drawings without creative efforts.

DETAILED DESCRIPTION OF ILLUSTRATIVE EMBODIMENTS

The following clearly describes the technical solutions in the embodiments of the present invention with reference to the accompanying drawings in the embodiments of the present invention. Apparently, the described embodiments are a part rather than all of the embodiments of the present invention. All other embodiments obtained by a person of ordinary skill in the art based on the embodiments of the present invention without creative efforts shall fall within the protection scope of the present invention.

Figure 1:
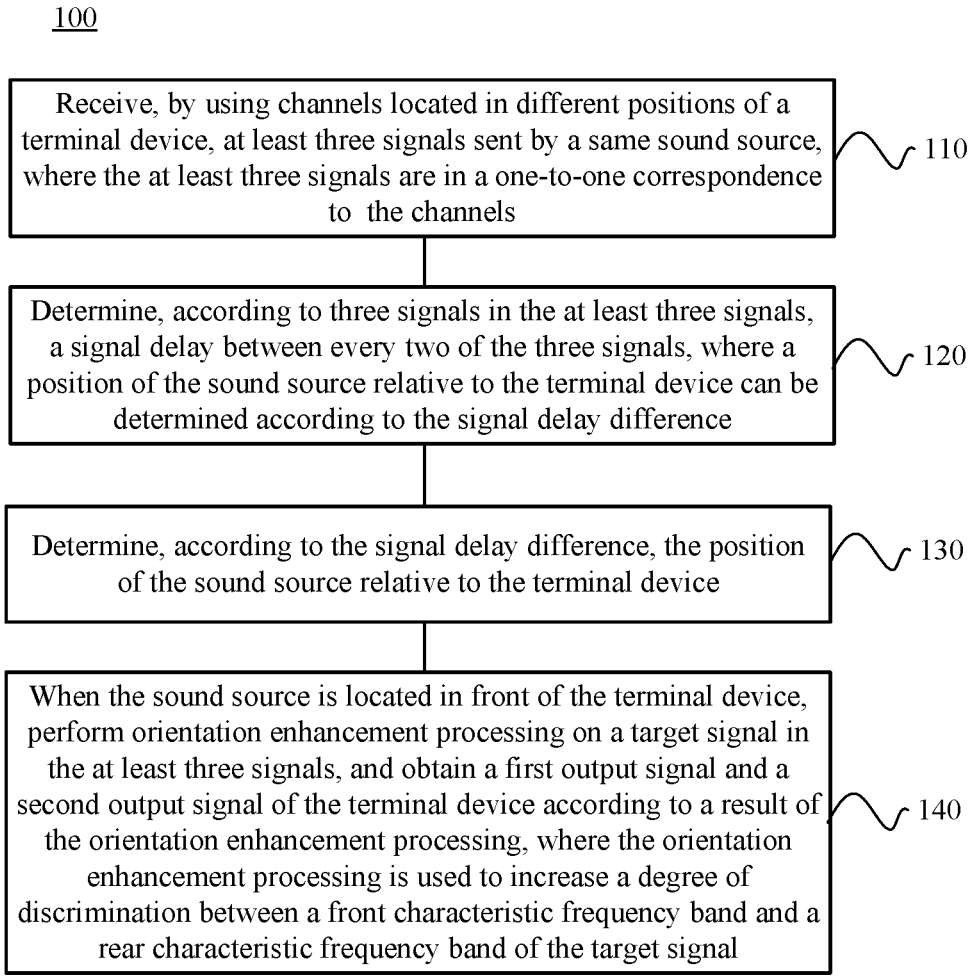
FIG. 1 is a schematic flowchart of a method for processing a sound signal according to an embodiment of the present invention.

FIG. 1 is a schematic flowchart of a method for processing a sound signal according to an embodiment of the present invention. The method 100 may be performed by a terminal device.

Step 110: Receive, by using channels located in different positions of a terminal device, at least three signals emit by a same sound source, where the at least three signals are in a one-to-one correspondence to the channels.

Step 120: Determine, according to three signals in the at least three signals, a signal delay difference between every two of the three signals, where a position of the sound source relative to the terminal device can be determined according to the signal delay difference.

Step 130: Determine, according to the signal delay difference, the position of the sound source relative to the terminal device.

Step 140: When the sound source is located in front of the terminal device, perform orientation enhancement processing on a target signal in the at least three signals, and obtain a first output signal and a second output signal of the terminal device according to a result of the orientation enhancement processing, where the orientation enhancement processing is used to increase a degree of discrimination between a front characteristic frequency band and a rear characteristic frequency band of the target signal.

In this embodiment of the present invention, a position of a sound source relative to a terminal device is determined, orientation enhancement processing is performed on a target signal emit by the sound source, and an output signal of the terminal device is obtained according to a result of the orientation enhancement processing, so that a degree of discrimination between a front characteristic frequency band and a rear characteristic frequency band of the output signal is increased. Therefore, perception of a sound image orientation of an output signal can be enhanced, and a probability of incorrectly determining a front sound image as a rear sound image is reduced.

In step 110, a multimedia terminal device has at least three channels in different positions, where the channels are used to collect at least three signals emit by a same sound source. Because the channels are in different positions, the received sound signals that are emit by the same sound source are also different. Therefore, a one-to-one correspondence exists between a signal actually received on each channel and a position of the channel. Therefore, according to the at least three signals, whether the sound source is located in front of or behind the terminal device may be determined, and more specifically, a specific interval of the front in which the sound source is located may be determined.

In step 120, the determining, according to three signals in the at least three signals, a signal delay difference between every two of the three signals, where a position of the sound source relative to the terminal device can be determined according to the signal delay difference, is: according to any three signals that are included in the sound signals and can determine the position of the sound source, a signal delay difference between every two of the three signals may be determined, and therefore, the position of the sound source relative to the terminal device is determined. It should be understood that, the any three signals that can determine the position of the sound source mean that the positions of the channels respectively receiving the three signals may form a triangular relationship, for determining whether the sound source is located in front of or behind the terminal device.

Optionally, in an embodiment of the present invention, a delay difference between any two signals may be measured by using a frequency domain related method. Specifically, for example, a Fourier coefficient of an $m^{th}$ signal is $H_m(f)$, and a Fourier coefficient of an $n^{th}$ signal is $H_m(f)$. In this case, a correlation function $\Phi_{mn}(\tau)$ of a head related transfer function (HRTF) of the $m^{th}$ signal and the $n^{th}$ signal is:

$$\Phi_{mn}(\tau) = \frac{\int_{-\infty}^{+\infty} H_m(f)H_n^*(f)\exp(j2\pi f\tau)df}{\left\{\left[\int_{-\infty}^{+\infty}|H_m(f)|^2df\right]\left[\int_{-\infty}^{+\infty}|H_n(f)|^2df\right]\right\}^{1/2}} \quad (1)$$

where * indicates conjugate, and $0 \le |\Phi_{mn}(\tau)| \le 1$. In a process of determining a sound image orientation, a low frequency is a decisive positioning factor. Therefore, a maximum value of $\Phi_{mn}(\tau)$ in a range of $f \le 2.24$ kHz and $|\tau| \le 1$ ms is calculated, and $\tau = \tau_{max}$ corresponding to this is a delay difference between the $m^{th}$ signal and the $n^{th}$ signal. Likewise, the delay difference between any two signals may be obtained. It should be understood that, the specific numeric value is only an example, and the delay difference between any two signals may also be obtained by using other specific numeric values or calculation formulas, but the present invention is not limited to this.

In step 130, whether the sound source is located in front of or behind the terminal device may be determined according to the signal delay difference, so that orientation enhancement processing is performed on a target signal in the at least three signals in step 140. The target signal may include one or more of the at least three signals, and specifically needs to be determined according to the position of the sound source relative to the terminal device, so that the orientation enhancement processing is performed on the target signal. It should be understood that, the target signal may collectively refer to a type of signal that requires orientation enhancement processing.

In an actual situation, a probability of incorrectly determining a front sound source as a rear sound source is far greater than a probability of incorrectly determining a rear sound source as a front sound source. Therefore, optionally, in an embodiment of the present invention, when the sound source is located in front of the terminal device, the orientation enhancement processing in step 140 includes: enhancement processing on the front characteristic frequency band; and/or suppression processing on the rear characteristic frequency band. The characteristic frequency bands are frequency bands that are divided according to an actual requirement and a magnitude relationship between a front spectral amplitude and a rear spectral amplitude of a signal, and can reflect signal characteristics. Specifically, the front characteristic frequency band is a characteristic frequency band in which a front spectral amplitude is far greater than a rear spectral amplitude; and the rear characteristic frequency band is a characteristic frequency band in which a rear spectral amplitude is far greater than a front spectral amplitude.

Optionally, in an embodiment of the present invention, the at least three signals received by the terminal device include a first signal received on a first channel, a second signal received on a second channel, and a third signal received on a third channel, the first channel is closer to the front than the second channel and the third channel, and the first channel is located between the second channel and the third channel. The performing orientation enhancement processing on a target signal in the at least three signals is specifically: when the first signal is the target signal, performing the orientation enhancement processing on the first signal to obtain a first processed signal. In this case, the obtaining a first output signal and a second output signal of the terminal device according to a result of the orientation enhancement processing is specifically: obtaining the first output signal according to the first processed signal and the second signal;

and obtaining the second output signal according to the first processed signal and the third signal.

It should be understood that, that the sound source is located in front of the terminal device means that when a user normally wears or uses the terminal device, the sound source is located on a half plane in front of the user. Optionally, the first channel is closer to the front than the second channel and the third channel from a perspective of the user. That the first channel is located between the second channel and the third channel means that an angular relationship is formed between the three channels, and that the position of the sound source relative to the terminal device may be determined by determining the delay difference between every two of the received signals.

Optionally, in an embodiment of the present invention, the at least three signals received by the terminal device include a first signal received on a first channel, a second signal received on a second channel, and a third signal received on a third channel, the first channel is closer to the front than the second channel and the third channel, and the first channel is located between the second channel and the third channel. The performing orientation enhancement processing on a target signal in the at least three signals is specifically: when all the first signal, the second signal, and the third signal are the target signals, performing the orientation enhancement processing on the first signal to obtain a first processed signal, performing the orientation enhancement processing on the second signal to obtain a second processed signal, and performing the orientation enhancement processing on the third signal to obtain a third processed signal. In this case, the obtaining a first output signal and a second output signal of the terminal device according to a result of the orientation enhancement processing is specifically: obtaining the first output signal according to the first processed signal and the second processed signal; and obtaining the second output signal according to the first processed signal and the third processed signal.

Optionally, in an embodiment of the present invention, the at least three signals received by the terminal device include a first signal received on a first channel, a second signal received on a second channel, and a third signal received on a third channel, the first channel is closer to the front than the second channel and the third channel, and the first channel is located between the second channel and the third channel. The performing orientation enhancement processing on a target signal in the at least three signals is specifically: when all the first signal, the second signal, and the third signal are the target signals, performing the orientation enhancement processing on the first signal to obtain a first processed signal, performing the orientation enhancement processing on the second signal to obtain a second processed signal, and performing the orientation enhancement processing on the third signal to obtain a third processed signal. In this case, the obtaining a first output signal and a second output signal of the terminal device according to a result of the orientation enhancement processing is specifically: obtaining the first output signal according to the first processed signal, the second processed signal, and the second signal; and obtaining the second output signal according to the first processed signal, the third processed signal, and the third signal.

It should be understood that, an effect of the processing manner of performing the orientation enhancement processing on the first signal, the second signal, and the third signal to respectively obtain the first processed signal, the second processed signal, and the third processed signal, and obtaining the first output signal and the second output signal respectively according on the result of the orientation enhancement processing and according to two different combination manners, may be slightly different from an effect of performing the orientation enhancement processing only on the first signal and obtaining the first output signal and the second output signal. However, regardless of which processing manner is used, the degree of discrimination between the front characteristic frequency band and the rear characteristic frequency band of the output signal can be increased. Therefore, perception of the sound image orientation of the output signal can be enhanced, and a probability of incorrectly determining a front sound image signal as a rear sound image signal is reduced. It should be understood that, there are multiple combination manners in which the orientation enhancement processing is performed on one or more signals to obtain the first output signal and the second output signal. Any combination manners may be feasible so long as it can enhance perception of the sound image orientation of the output signal and reduce the probability of incorrectly determining a front sound image signal as a rear sound image signal. For example, the orientation enhancement processing is performed only on the second signal and the third signal, and the first output signal and the second output signal are obtained according to the first signal, and the second processed signal and the third processed signal that are obtained after the orientation enhancement processing. The present invention is not limited to this.

Optionally, in an embodiment of the present invention, the method for processing a sound signal may further include: performing, according to a signal amplitude in each characteristic frequency band of the second signal and a signal amplitude in each characteristic frequency band of the third signal, an amplitude adjustment on each characteristic frequency band corresponding to the first processed signal, so as to obtain the first output signal and the second output signal, where the first processed signal, the second signal, and the third signal are divided into the characteristic frequency bands in a same manner. For example, in a same division manner, the first processed signal, the second signal, and the third signal are all divided into five characteristic frequency bands: [3 kHz, 8 kHz], [8 kHz, 10 kHz], [10 kHz, 12 kHz], [12 kHz, 17 kHz], and [17 kHz, 20 kHz]. In this case, in a characteristic frequency band such as the frequency band [3 kHz, 8 kHz], an amplitude adjustment needs to be performed on the first signal according to signal amplitudes of the second signal and the third signal.

Optionally, in an embodiment of the present invention, the at least three signals received by the terminal device include a first type of signal received on a first type of channel, a second signal received on a second channel, and a third signal received on a third channel, the first type of channel includes at least two channels, the at least two channels are respectively used to receive at least two signals, any channel in the first type of channel is closer to the front than the second channel and the third channel, and the first type of channel is located between the second channel and the third channel. The performing orientation enhancement processing on a target signal in the at least three signals is specifically: when at least one signal in the first type of signal is the target signal, performing the orientation enhancement processing on the at least one signal in the first type of signal to obtain a first type of processed signal. In this case, the obtaining a first output signal and a second output signal of the terminal device according to a result of the orientation enhancement processing is specifically: obtaining the first output signal according to the first type of processed signal and the second signal; and obtaining the second output signal according to the first type of processed signal and the third signal.

Specifically, for example, the first type of channel includes two channels that are channel A and channel B respectively, and signals received on the two channels are signal A and signal B respectively. In this case, only signal A may be selected as the target signal, or only signal B may be selected as the target signal, or both signal A and signal B are selected as the target signals; and the first output signal and the second output signal are obtained according the result of the orientation enhancement processing performed on the target signal.

Optionally, in an embodiment of the present invention, the at least three signals received by the terminal device include a first type of signal received on a first type of channel, a second signal received on a second channel, and a third signal received on a third channel, the first type of channel includes at least two channels, the at least two channels are respectively used to receive at least two signals, any channel in the first type of channel is closer to the front than the second channel and the third channel, and the first type of channel is located between the second channel and the third channel. The performing orientation enhancement processing on a target signal in the at least three signals is specifically: when at least one signal in the first type of signal, the second signal, and the third signal are the target signals, performing the orientation enhancement processing on the at least one signal in the first type of signal to obtain a first type of processed signal, performing the orientation enhancement processing on the second signal to obtain a second processed signal, and performing the orientation enhancement processing on the third signal to obtain a third processed signal. In this case, the obtaining a first output signal and a second output signal of the terminal device according to a result of the orientation enhancement processing is specifically: obtaining the first output signal according to the first type of processed signal and the second processed signal; and obtaining the second output signal according to the first type of processed signal and the third processed signal.

Optionally, in an embodiment of the present invention, the at least three signals received by the terminal device include a first type of signal received on a first type of channel, a second signal received on a second channel, and a third signal received on a third channel, the first type of channel includes at least two channels, the at least two channels are respectively used to receive at least two signals, and any channel in the first type of channel is closer to the front than the second channel and the third channel. The performing orientation enhancement processing on a target signal in the at least three signals is specifically: when at least one signal in the first type of signal, the second signal, and the third signal are the target signals, performing the orientation enhancement processing on the at least one signal in the first type of signal to obtain a first type of processed signal, performing the orientation enhancement processing on the second signal to obtain a second processed signal, and performing the orientation enhancement processing on the third signal to obtain a third processed signal. In this case, the obtaining a first output signal and a second output signal of the terminal device according to a result of the orientation enhancement processing is specifically: obtaining the first output signal according to the first type of processed signal, the second processed signal, and the second signal; and obtaining the second output signal according to the first type of processed signal, the third processed signal, and the third signal.

It should be understood that, an effect of the processing manner of performing the orientation enhancement processing on the at least one signal in the first type of signal, the second signal, and the third signal to respectively obtain the first type of processed signal, the second processed signal, and the third processed signal, and obtaining the first output signal and the second output signal respectively according on the result of the orientation enhancement processing and according to two different combination manners, may be slightly different from an effect of performing the orientation enhancement processing only on the at least one signal in the first type of signal and obtaining the first output signal and the second output signal. However, regardless of which processing manner is used, the degree of discrimination between the front characteristic frequency band and the rear characteristic frequency band of the output signal can be increased. Therefore, perception of the sound image orientation of the output signal can be enhanced, and the probability of incorrectly determining a front sound image signal as a rear sound image signal is reduced. It should be understood that, there are multiple combination manners in which the orientation enhancement processing is performed on one or more signals to obtain the first output signal and the second output signal. Any combination manners may be feasible so long as it can enhance perception of the sound image orientation of the output signal and reduce the probability of incorrectly determining a front sound image signal as a rear sound image signal. The present invention is not limited to this.

Optionally, in an embodiment of the present invention, the at least three signals received by the terminal device include a first signal received on a first channel, a second signal received on a second channel, a third signal received on a third channel, a fourth signal received on a fourth channel, and a fifth signal received on a fifth channel, the first channel, the second channel, or the third channel is closer to the front than the fourth channel and the fifth channel, the first channel, the second channel, and the third channel are located between the fourth channel and the fifth channel, and the front of the terminal device is divided into a first interval, a second interval, and a third interval that are adjacent. The performing orientation enhancement processing on a target signal in the at least three signals is specifically: when the sound source is located in the first interval and the first signal is the target signal, performing the orientation enhancement processing on the first signal to obtain a first processed signal; when the sound source is located in the second interval of the terminal device and the second signal is the target signal, performing the orientation enhancement processing on the second signal to obtain a second processed signal; or when the sound source is located in the third interval of the terminal device and the third signal is the target signal, performing the orientation enhancement processing on the third signal to obtain a third processed signal. In this case, the obtaining a first output signal and a second output signal of the terminal device according to a result of the orientation enhancement processing is specifically: when the sound source is located in the first interval, obtaining the first output signal according to the first processed signal and the fourth signal, and obtaining the second output signal according to the first processed signal and the fifth signal; when the sound source is located in the second interval, obtaining the first output signal according to the second processed signal and the fourth signal, and obtaining the second output signal according to the second processed signal and the fifth signal; or when the sound source is located in the third interval, obtaining the first output signal according to the third processed signal and the fourth signal, and obtaining the second output signal according to the third processed signal and the fifth signal.

Optionally, in an embodiment of the present invention, the at least three signals received by the terminal device include a first signal received on a first channel, a second signal received on a second channel, a third signal received on a third channel, a fourth signal received on a fourth channel, and a fifth signal received on a fifth channel, the first channel, the second channel, or the third channel is closer to the front than the fourth channel and the fifth channel, the first channel, the second channel, and the third channel are located between the fourth channel and the fifth channel, and the front of the terminal device is divided into a first interval, a second interval, and a third interval that are adjacent. The performing orientation enhancement processing on a target signal in the at least three signals is specifically: when the sound source is located in the first interval, and all the first signal, the fourth signal, and the fifth signal are the target signals, performing the orientation enhancement processing on the first signal to obtain a first processed signal, performing the orientation enhancement processing on the fourth signal to obtain a fourth processed signal, and performing the orientation enhancement processing on the fifth signal to obtain a fifth processed signal; when the sound source is located in the second interval, and all the second signal, the fourth signal, and the fifth signal are the target signals, performing the orientation enhancement processing on the second signal to obtain a second processed signal, performing the orientation enhancement processing on the fourth signal to obtain a fourth processed signal, and performing the orientation enhancement processing on the fifth signal to obtain a fifth processed signal; or when the sound source is located in the third interval, and all the third signal, the fourth signal, and the fifth signal are the target signals, performing the orientation enhancement processing on the third signal to obtain a third processed signal, performing the orientation enhancement processing on the fourth signal to obtain a fourth processed signal, and performing the orientation enhancement processing on the fifth signal to obtain a fifth processed signal. In this case, the obtaining a first output signal and a second output signal of the terminal device according to a result of the orientation enhancement processing is specifically: when the sound source is located in the first interval, obtaining the first output signal according to the fourth processed signal and the first processed signal, and obtaining the second output signal according to the fifth processed signal and the first processed signal; when the sound source is located in the second interval, obtaining the first output signal according to the fourth processed signal and the second processed signal, and obtaining the second output signal according to the fifth processed signal and the second processed signal; or when the sound source is located in the third interval, obtaining the first output signal according to the fourth processed signal and the third processed signal, and obtaining the second output signal according to the fifth processed signal and the third processed signal.

It should be understood that, an effect of the processing manner of performing the orientation enhancement processing on the first signal, the fourth signal, and the fifth signal to respectively obtain the first processed signal, the fourth processed signal, and the fifth processed signal, and obtaining the first output signal and the second output signal according on the result of the orientation enhancement processing, may be slightly different from an effect of performing the orientation enhancement processing only on the first signal and obtaining the first output signal and the second output signal. However, regardless of which processing manner is used, the degree of discrimination between the front characteristic frequency band and the rear characteristic frequency band of the output signal can be increased. Therefore, perception of the sound image orientation of the output signal can be enhanced, and the probability of incorrectly determining a front sound image signal as a rear sound image signal is reduced. It should be understood that, there are multiple combination manners in which the orientation enhancement processing is performed on one or more signals to obtain the first output signal and the second output signal. Any combination manners may be feasible so long as it can enhance perception of the sound image orientation of the output signal and reduce the probability of incorrectly determining a front sound image signal as a rear sound image signal. The present invention is not limited to this.

Optionally, in an embodiment of the present invention, the method for processing a sound signal further includes: when the sound source is located in the first interval, performing, according to a signal amplitude in each characteristic frequency band of the fourth signal and a signal amplitude in each characteristic frequency band of the fifth signal, an amplitude adjustment on each characteristic frequency band corresponding to the first processed signal, so as to obtain the first output signal and the second output signal; when the sound source is located in the second interval, performing, according to a signal amplitude in each characteristic frequency band of the fourth signal and a signal amplitude in each characteristic frequency band of the fifth signal, an amplitude adjustment on each characteristic frequency band corresponding to the second processed signal, so as to obtain the first output signal and the second output signal; or when the sound source is located in the third interval, performing, according to a signal amplitude in each characteristic frequency band of the fourth signal and a signal amplitude in each characteristic frequency band of the fifth signal, an amplitude adjustment on each characteristic frequency band corresponding to the third processed signal, so as to obtain the first output signal and the second output signal; where the first processed signal, the second processed signal, the third processed signal, the fourth signal, and the fifth signal are divided into the characteristic frequency bands in a same manner.

Specifically, for example, the first processed signal, the fourth signal, and the fifth signal are all divided into five characteristic frequency bands: [3 kHz, 8 kHz], [8 kHz, 10 kHz], [10 kHz, 12 kHz], [12 kHz, 17 kHz], and [17 kHz, 20 kHz]. In this case, in a characteristic frequency band such as the frequency band [3 kHz, 8 kHz], an amplitude adjustment needs to be performed on the first processed signal according to signal amplitudes of the fourth signal and the fifth signal. It should be understood that, the division of frequency bands and settings of numeric values are examples, but the present invention is not limited to this.

Optionally, when the sound source is located in the first interval, the first signal received on the first channel is the target signal. Because the first channel is located in the first interval, for the user, the first channel is closer to the sound source than other channels or earlier receives the signal emit by the sound source. It should be understood that, performing the orientation enhancement processing on the first signal means when the sound source is located in a specific position in front of the terminal device, performing the orientation enhancement processing on a signal received on a channel closer to the sound source in the specific position.

This processing manner can more effectively reduce the probability of incorrectly determining a front sound image as a rear sound image. By analogy, cases in which the sound source is located in the second interval and the third interval may be learned. It should also be understood that, the present invention is not limited to the case of dividing the front of the user into three adjacent intervals. The front may be flexibly divided into two or more than two adjacent intervals, and a signal received on a corresponding channel in the interval is selected for orientation enhancement processing. Any signal combination manner may be feasible so long as it can reduce a probability of incorrectly determining a front/rear sound image, but the present invention is not limited to this.

In this embodiment of the present invention, a position of a sound source relative to a terminal device is determined, orientation enhancement processing is performed on a target signal emit by the sound source, and an output signal of the terminal device is obtained according to a result of the orientation enhancement processing, so that a degree of discrimination between a front characteristic frequency band and a rear characteristic frequency band of the output signal is increased. Therefore, perception of a sound image orientation of an output signal can be enhanced, and a probability of incorrectly determining a front sound image as a rear sound image is reduced.

Figure 2:
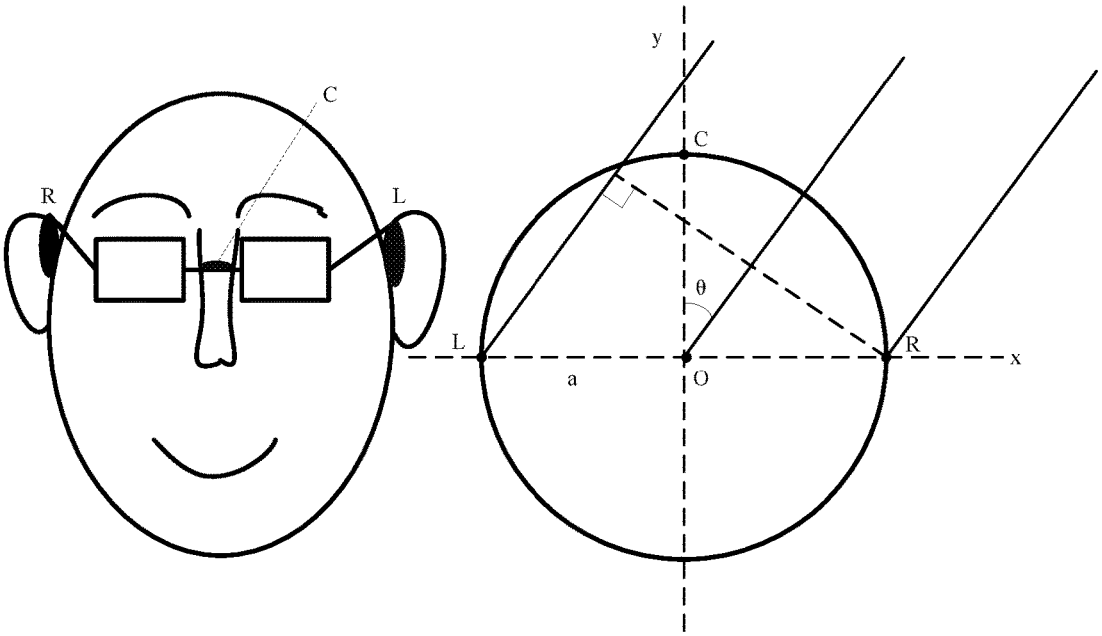
FIG. 2 is a schematic structural diagram of a terminal device according to an embodiment of the present invention.

FIG. 2 is a schematic structural diagram of a terminal device according to an embodiment of the present invention. As shown in a left diagram in FIG. 2, the terminal device is a head-mounted multimedia system, and three channels located in different positions of the terminal device, namely, a left channel (channel L), a right channel (channel R), and a center channel (channel C), are used to collect sound signals. A right diagram in FIG. 2 shows a simplified schematic diagram of the terminal device. The positions in which channel R, channel L, and channel C are located are simplified as a circle with a radius of a, where an origin of coordinates is O, an included angle between an incident direction and a y-axis is θ, and a coordinate system is established clockwise. In this case, an angle directly corresponding to the front is θ=0°, an angle directly corresponding to the right is θ=90°, and an angle directly corresponding to the left is θ=270°.

Step 1: Receive signals received on channel L, channel R, and channel C.

Step 2: Measure a delay difference between every two of the signals received on channel L, channel R, and channel C. A frequency domain related method is used to measure a delay difference between every two of the channels. Specifically, a Fourier coefficient of the signal received on channel L is $H_L(f)$, and a Fourier coefficient of the signal received on channel R is $H_R(f)$. In this case, a correlation function $\Phi_{LR}(\tau)$ of a head related transfer function (HRTF) of channels R and L is:

$$\Phi_{LR}(\tau) = \frac{\int_{-\infty}^{+\infty} H_L(f)H_R^*(f)\exp(j2\pi f\tau)df}{\left\{\left[\int_{-\infty}^{+\infty}|H_L(f)|^2df\right]\left[\int_{-\infty}^{+\infty}|H_R(f)|^2df\right]\right\}^{1/2}} \quad (1)$$

where * indicates conjugate, and $0 \le |\Phi_{LR}(\tau)| \le 1$. In a process of determining a sound image orientation, a low frequency is a decisive positioning factor. Therefore, a maximum value of $\Phi_{LR}(t)$ in a range of f≤2.24 kHz and $|\tau| \le 1$ ms is calculated, and $\tau=\tau_{max}$ corresponding to this is a delay difference $ITD_{LR}$ between the signal in channel L and the signal in channel R. Likewise, a delay difference $ITD_{LC}$ between the signal received on channel L and the signal received on channel C and a delay difference $ITD_{RC}$ between the signal received on channel R and the signal received on channel C may be obtained. Specifically, other manners may also be used in the method for measuring the delay differences between the signals in the channels, but the present invention is not limited to this.

When the head is unblocked, an incident direction of a sound source may be directly determined by using a delay difference between every two of the signals received on channels L, R, and C:

$$\theta_{LR} = \arcsin\left(\frac{c \cdot ITD_{LR}}{2a}\right), \theta_{LR} \in [-90°, 90°] \quad (2)$$

Likewise, the following may be obtained:

$$\theta_{LC} = \arcsin\left(\frac{c \cdot ITD_{LC}}{\sqrt{2}a}\right) - 45, \theta_{LC} \in [-135°, 45°] \quad (3)$$

$$\theta_{RC} = 45 - \arcsin\left(\frac{c \cdot ITD_{RC}}{\sqrt{2}a}\right), \theta_{RC} \in [-45°, 135°] \quad (4)$$

In an actual situation, because the head is blocked, when the sound source is in a range of approximately 45° in front to 45° behind, a sound source direction obtained through calculation by using the formula (2) is more accurate; when the sound source is located in two side directions, a result obtained through calculation by using the formula (3) or (4) is closer to an actual sound source direction.

Step 3: Determine a position of a sound source relative to a terminal device. First, calculate $\theta_{LR}$, $\theta_{LC}$, and $\theta_{RC}$ respectively by using the formula (2) to the formula (4). Then, using the frequency domain related measurement method shown in the formula (1), determine the delay difference $ITD_{LR}$ between the signals received on channels L and R, the delay difference $ITD_{LC}$ between the signals received on channels L and C, and the delay difference $ITD_{RC}$ between the signals received on channels R and C, and estimate an azimuth $\theta_e$ of the sound source according to the delay differences.

Specifically, assume $$\frac{c \cdot ITD_{LR}}{2a} = m.$$

When m is greater than 0, it indicates that the sound source is located on a right half plane. In this case:

when $0 \le m < \sqrt{2}/2$, the azimuth of the sound source is 0° to 45° or 135° to 180°, and assume $\theta_e=\theta_{LR}$;

if $|ITD_{LC}|>|ITD_{RC}|$, the sound source is located in front, or if $|ITD_{LC}|<|ITD_{RC}|$, the sound source is located behind;

when $\sqrt{2}/2 \le m \le 1$, the corresponding azimuth of the sound source is 45° to 135°, and assume $\theta_e=\theta_{RC}$;

if $|ITD_{LC}|>|ITD_{RC}|$, the sound source is located in front, or if $|ITD_{LC}|<|ITD_{RC}|$, the sound source is located behind;

when m>1, assume $\theta_e=\theta_{RC}$;

if $|ITD_{LC}|>|ITD_{RC}|$, the sound source is located in front, or if $|ITD_{LC}|<|ITD_{RC}|$, the sound source is located behind.

When m is less than 0, it indicates that the sound source is located on a left half plane. In this case:

when $-\sqrt{2}/2<m<0$, the corresponding azimuth of the sound source is 180° to 225°, and assume $\theta_e=\theta_{LR}$;

if $|ITD_{LC}|>|ITD_{RC}|$, the sound source is located in front, or if $|ITD_{LC}|<|ITD_{RC}|$, the sound source is located behind;

when $-1\leq m\leq-\sqrt{2}/2$, the corresponding azimuth of the sound source is 225° to 315°, and assume $\theta_e=\theta_{LC}$;

if $|ITD_{LC}|>|ITD_{RC}|$, the sound source is located in front, or if $|ITD_{LC}|<|ITD_{RC}|$, the sound source is located behind;

when $m<-1$, assume $\theta_e=\theta_{LC}$;

if $|ITD_{LC}|>|ITD_{RC}|$, the sound source is located in front, or if $|ITD_{LC}|<|ITD_{RC}|$, the sound source is located behind.

Step 4: When it is determined that the sound source is located in front of the terminal device, the signal received on channel C is a target signal, orientation enhancement processing is performed on the signal received on channel C to obtain a processed target signal, and a left output signal and a right output signal of the terminal device are obtained according to the signal in channel C after the orientation enhancement processing; when it is determined that the sound source is located in another position of the terminal device, the signal received on the left channel is output as a left-ear output signal, and the signal received on the right channel is output as a right-ear output signal. When it is determined that the sound source is located in front of the terminal device, a specific processing procedure may be as follows:

$$L' = L + \sum_{i=1}^{N} GA_i \times H_{bandi} \otimes C,$$

$$R' = R + \sum_{i=1}^{N} GA_i \times H_{bandi} \otimes C$$

where the signal received on channel R is R, the signal received on channel L is L, the signal received on channel C is C, the right-ear output signal is R', and the left-ear output signal is L'; $\otimes$ indicates a convolution of two signals, so as to implement a filter function; $H_{low}$ indicates a low-pass filter whose cut-off frequency is $F_1$; $H_{bandi}$ indicates a band-pass filter, and a passband of the filter is $[F_i\ F_{i+1}]$; $GA_i$ indicates a filter gain coefficient when a gain adjustment is performed on the signal received on channel C.

In this embodiment, N=5, representing that the signal is divided into five characteristic frequency bands, and is specifically divided into the following frequencies: $F_1$=3 kHz, $F_2$=8 kHz, $F_3$=10 kHz, $F_4$=12 kHz, $F_5$=17 kHz, and $F_6$=20 kHz. A gain coefficient of each characteristic frequency band is as follows: $GA_1$=0.5, $GA_2$=0, $GA_3$=0.5, $GA_4$=0, and $GA_5$=0.5. $G_i$=2 indicates a 6 dB spectral amplitude gain. $G_i$=0.5 indicates a 3 dB spectral amplitude attenuation. By using $GA_i$, different gain adjustments are performed on different frequency bands of the signal in the center channel. After amplitude gain adjustments are performed on the three characteristic frequency bands $H_{band1}$, $H_{band3}$, and $H_{band5}$ in which there are obvious differences between front and rear spectral amplitudes and in which a front response is far higher than a rear response, and after amplitude attenuation (suppression) adjustments are performed on the two characteristic frequency bands $H_{band2}$ and $H_{band4}$ in which there are obvious differences between front and rear spectral amplitudes and in which a rear response is far higher than a front response, adjusted signals are respectively added to corresponding frequency band signals in the left and right channels, so that differences between front and rear spectral amplitudes of the output signals of the left and right channels are enhanced.

It should be understood that, the division of the front and rear characteristic frequency bands and selection of the gain coefficient of each frequency band are based on an increase of a difference between a front spectrum and a rear spectrum, but this difference should not be exaggerated excessively, so as to avoid an apparent timbre distortion. The present invention is not limited to the specific setting of gain coefficients and division of frequency bands. It should also be understood that, according to different relative positions of the receiving channels, there are corresponding calculation methods for determining the orientation of the sound source relative to the terminal device, but the present invention is not limited to the specific calculation formulas.

Optionally, in an embodiment of the present invention, in step 4, when it is determined that the sound source is located in front of the terminal device, all the signal received on channel C, the signal received on channel L, and the signal received on channel R are target signals, orientation enhancement processing is performed on the signal received on channel C, orientation enhancement processing is performed on the signals received on channel R and channel L, a left output signal of the terminal device is obtained according to the signal in channel C after the orientation enhancement processing and the signal received in channel L after the orientation enhancement processing, and a right output signal of the terminal device is obtained according to the signal in channel C after the orientation enhancement processing and the signal received on channel R after the orientation enhancement processing; when it is determined that the sound source is located in another position of the terminal device, the signal received on the left channel is output as a left-ear output signal, and the signal received on the right channel is output as a right-ear output signal. When it is determined that the sound source is located in front of the terminal device, a specific processing procedure is as follows:

$$L' = G_1 \times H_{low} \otimes L + \sum_{i=1}^{N} G_{i+1} \times H_{bandi} \otimes L + \sum_{i=1}^{N} GA_i \times H_{bandi} \otimes C,$$

$$R' = G_1 \times H_{low} \otimes R + \sum_{i=1}^{N} G_{i+1} \times H_{bandi} \otimes R + \sum_{i=1}^{N} GA_i \times H_{bandi} \otimes C$$

where the signal received on channel R is R, the signal received on channel L is L, the signal received on channel C is C, the right-ear output signal is R', and the left-ear output signal is L'; $\otimes$ indicates a convolution of two signals, so as to implement a filter function; $H_{low}$ indicates a low-pass filter whose cut-off frequency is $F_1$; $H_{bandi}$ indicates a band-pass filter, and a passband of the filter is $[F_i\ F_{i+1}]$; $G_i$ indicates a filter gain coefficient when a gain adjustment is performed on the signal received on channel L or R, and $GA_i$ indicates a filter gain coefficient when a gain adjustment is performed on the signal received on channel C.

In this embodiment, N=5, representing that the signal is divided into five characteristic frequency bands, and is specifically divided into the following frequencies: $F_1$=3 kHz, $F_2$=8 kHz, $F_3$=10 kHz, $F_4$=12 kHz, $F_5$=17 kHz, and $F_6$=20 kHz. A gain coefficient of each characteristic frequency band is as follows: $G_1$=1, $G_2$=2, $G_3$=0.5, $G_4$=2, $G_5$=0.5, $G_6$=2, $GA_1$=0.5, $GA_2$=0, $GA_3$=0.5, $GA_4$=0, and $GA_5$=0.5. $G_i$=2 indicates a 6 dB spectral amplitude gain. $G_i$=0.5 indicates a 3 dB spectral amplitude attenuation. By using $G_i$, different gain adjustments are performed on different frequency bands of the signals received on channels R and L. By using $GA_i$, different gain adjustments are performed on different frequency bands of the signal received on channel C. After amplitude gain adjustments are performed on the three characteristic frequency bands $H_{band1}$, $H_{band3}$, and $H_{band5}$ in which there are obvious differences between front and rear spectral amplitudes and in which a front response is far higher than a rear response, and after amplitude attenuation (suppression) adjustments are performed on the two characteristic frequency bands $H_{band2}$ and $H_{band4}$ in which there are obvious differences between front and rear spectral amplitudes and in which a rear response is far higher than a front response, adjusted signals are respectively added to corresponding adjusted frequency band signals received on channels R and L, so that differences between front and rear spectral amplitudes of the output signals of the left and right channels are enhanced.

It should be understood that, the division of the front and rear characteristic frequency bands and selection of the gain coefficient of each frequency band are based on an increase of a difference between a front spectrum and a rear spectrum, but this difference should not be exaggerated excessively, so as to avoid an apparent timbre distortion. The present invention is not limited to the specific setting of gain coefficients and division of frequency bands.

Optionally, in an embodiment of the present invention, in step 4, when it is determined that the sound source is located in front of the terminal device, all the signal received on channel C, the signal received on channel L, and the signal received on channel R are target signals, orientation enhancement processing is performed on the signal received on channel C, orientation enhancement processing is performed on the signals received on channel R and channel L, a left output signal of the terminal device is obtained according to the original signal received on channel L, the signal in channel C after the orientation enhancement processing, and the signal received on channel L after the orientation enhancement processing, and a right output signal of the terminal device is obtained according to the original signal received on channel R, the signal in channel C after the orientation enhancement processing, and the signal received on channel R after the orientation enhancement processing; when it is determined that the sound source is located in another position of the terminal device, the signal received on the left channel is output as a left-ear output signal, and the signal received on the right channel is output as a right-ear output signal. When it is determined that the sound source is located in front of the terminal device, a specific processing procedure is as follows:

$$L' = L + G_1 \times H_{low} \otimes L + \sum_{i=1}^{N} G_{i+1} \times H_{bandi} \otimes L + \sum_{i=1}^{N} GA_i \times H_{bandi} \otimes C,$$

$$R' = R + G_1 \times H_{low} \otimes R + \sum_{i=1}^{N} G_{i+1} \times H_{bandi} \otimes R + \sum_{i=1}^{N} GA_i \times H_{bandi} \otimes C$$

where the signal received on channel R is R, the signal received on channel L is L, the signal received on channel C is C, the right-ear output signal is R', and the left-ear output signal is L'; ⊗ indicates a convolution of two signals, so as to implement a filter function; $H_{low}$ indicates a low-pass filter whose cut-off frequency is $F_1$; $H_{bandi}$ indicates a band-pass filter, and a passband of the filter is $[F_i\ F_{i+1}]$; $G_i$ indicates a filter gain coefficient when a gain adjustment is performed on the signal received on channel L or R, and $GA_i$ indicates a filter gain coefficient when a gain adjustment is performed on the signal received on channel C.

In this embodiment, N=5, representing that the signal is divided into five characteristic frequency bands, and is specifically divided into the following frequencies: $F_1$=3 kHz, $F_2$=8 kHz, $F_3$=10 kHz, $F_4$=12 kHz, $F_5$=17 kHz, and $F_6$=20 kHz. A gain coefficient of each characteristic frequency band is as follows: $G_1$=1, $G_2$=2, $G_3$=0.5, $G_4$=2, $G_5$=0.5, $G_6$=2, $GA_1$=0.5, $GA_2$=0, $GA_3$=0.5, $GA_4$=0, and $GA_5$=0.5. $G_i$=2 indicates a 6 dB spectral amplitude gain. $G_i$=0.5 indicates a 3 dB spectral amplitude attenuation. By using $G_i$, different gain adjustments are performed on different frequency bands of the signals received on channels R and L. By using $GA_i$, different gain adjustments are performed on different frequency bands of the signal received on channel C. After amplitude gain adjustments are performed on the three characteristic frequency bands $H_{band1}$, $H_{band3}$, and $H_{band5}$ in which there are obvious differences between front and rear spectral amplitudes and in which a front response is far higher than a rear response, and after amplitude attenuation (suppression) adjustments are performed on the two characteristic frequency bands $H_{band2}$ and $H_{band4}$ in which there are obvious differences between front and rear spectral amplitudes and in which a rear response is far higher than a front response, adjusted signals are respectively added to corresponding adjusted frequency band signals received on channels R and L, so that differences between front and rear spectral amplitudes of the output signals of the left and right channels are enhanced.

It should be understood that, the division of the front and rear characteristic frequency bands and selection of the gain coefficient of each frequency band are based on an increase of a difference between a front spectrum and a rear spectrum, but this difference should not be exaggerated excessively, so as to avoid an apparent timbre distortion. The present invention is not limited to the specific setting of gain coefficients and division of frequency bands.

In the foregoing four steps in the embodiments of the present invention, a position of a sound source relative to a terminal device is determined, orientation enhancement processing is performed on a target signal emit by the sound source, and an output signal of the terminal device is obtained according to according on a result of the orientation enhancement processing, so that a degree of discrimination between a front characteristic frequency band and a rear characteristic frequency band of the output signal is increased. Therefore, perception of a sound image orientation of an output signal can be enhanced, and a probability of incorrectly determining a front sound image as a rear sound image is reduced.

Figure 3:
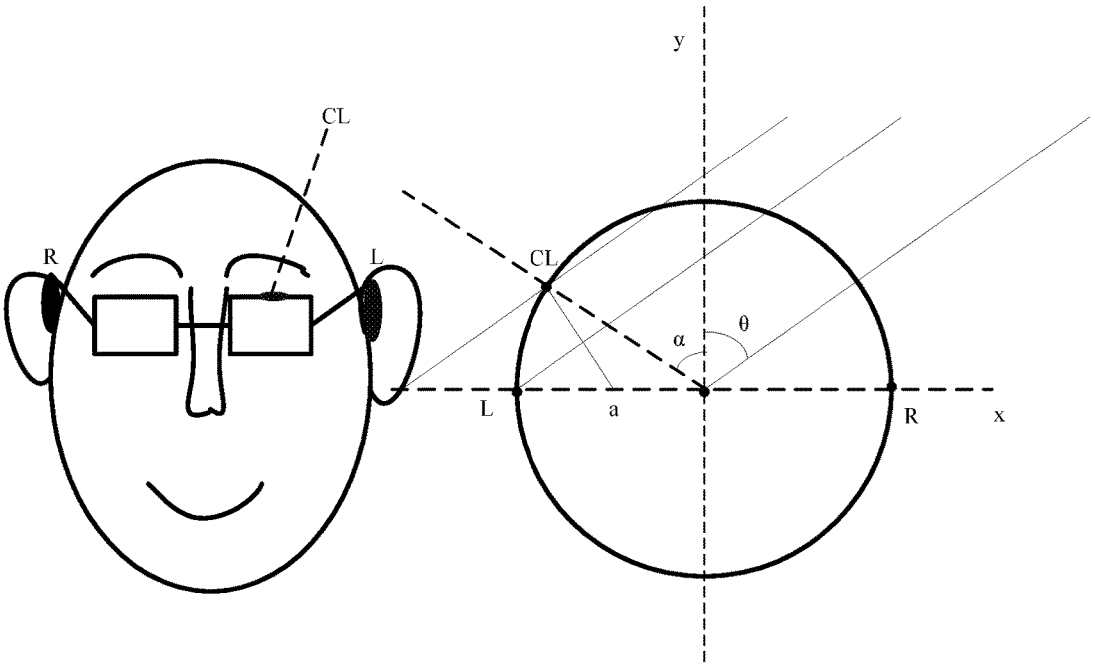
FIG. 3 is a schematic structural diagram of a terminal device according to another embodiment of the present invention.

FIG. 3 is a schematic structural diagram of a terminal device according to another embodiment of the present invention. As shown in a left diagram in FIG. 3, the terminal device is a head-mounted multimedia system, and three channels located in different positions of the terminal device, namely, a left channel (channel L), a right channel (channel R), and a center-left channel (channel CL), are used to collect sound signals. It should be understood that, the present invention is not limited to the left-side channel, and the left-side channel is merely used as an example for description. Channels in other positions that are located in front of channel R and channel L and located between channel R and channel L may also be used. A right diagram in FIG. 3 shows a simplified schematic diagram of the terminal device. The positions in which channel R, channel L, and channel CL are located are simplified as a circle with a radius of a, where an origin of coordinates is O, an included angle between an incident direction and a y-axis is θ, an included angle between channel CL and the y-axis is α, and a coordinate system is established clockwise. In this case, the front is directly θ=0°, the right directly corresponds to θ=90°, and the left directly corresponds to θ=270°.

Step 1: Collect signals received on channel L, channel R, and channel CL.

Step 2: Measure a delay difference between every two of the signals received on channel L, channel R, and channel CL. A frequency domain related method is used to measure the delay difference between every two of the signals. The formula (1) may be used to obtain a delay difference $ITD_{LCL}$ between the signal received on channel L and the signal received on channel CL, a delay difference $ITD_{RCL}$ between the signal received on channel R and the signal received on channel CL, and a delay difference $ITD_{LR}$ between the signal received on channel L and the signal received on channel R. It should be understood that, specifically, other manners may also be used in the method for measuring the delay differences between the signals in the channels, but the present invention is not limited to this.

When the head is unblocked, an incident direction of a sound source may be determined by using the delay differences between the signals received on channels L, R, and CL:

$$\theta_{LR} = \arcsin\left(\frac{c \cdot ITD_{LR}}{2a}\right) \tag{5}$$

Likewise, the following may be obtained:

$$\theta_{LCL} = \arcsin\left(\frac{c \cdot ITD_{LCL}}{2a \times r_1}\right) - \left(45 + \frac{\alpha}{2}\right),\ r_1 = \sin\left(\frac{90-\alpha}{2}\right) \tag{6}$$

$$\theta_{RCL} = \left(45 + \frac{\alpha}{2}\right) - \arcsin\left(\frac{c \cdot ITD_{RCL}}{2a \times r_2}\right),\ r_2 = \cos\left(\frac{90-\alpha}{2}\right) \tag{7}$$

Step 3: Determine a position of a sound source relative to a terminal device. First, calculate $\theta_{LR}$, $\theta_{LCL}$, and $\theta_{RCL}$ by using the formula (5) to the formula (7). Then, using the frequency domain related measurement method shown in the formula (1), determine $ITD_{LCL}$, $ITD_{RCL}$, and $ITD_{LR}$.

Specifically, assume $$\frac{c \cdot ITD_{LR}}{2a} = m.$$

When m is greater than 0, it indicates that the sound source is located on a right half plane. In this case:

when $0 \le m < \sqrt{2}/2$, an azimuth of the sound source is in a range of 0° to 45° or 135° to 180°, and assume $\theta_e = \theta_{LR}$;

if $|ITD_{LCL}|/r_1 > |ITD_{RCL}|$, the sound source is located in front, or if $|ITD_{LCL}|/r_1 < |ITD_{RCL}|$, the sound source is located behind;

when $\sqrt{2}/2 \le m \le 1$, the corresponding azimuth of the sound source is 45° to 135°, and assume $\theta_e = \theta_{RCL}$;

if $|ITD_{LCL}|/r_1 > |ITD_{RCL}|$, the sound source is located in front, or if $|ITD_{LCL}|/r_1 < |ITD_{RCL}|$, the sound source is located behind;

when m>1, assume $\theta_e = \theta_{RCL}$;

if $|ITD_{LCL}|/r_1 > |ITD_{RCL}|$, the sound source is located in front, or if $|ITD_{LCL}|/r_1 < |ITD_{RCL}|$, the sound source is located behind.

When m is less than 0, it indicates that the sound source is located on a left half plane. In this case:

when $-\sqrt{2}/2 < m < 0$, the corresponding azimuth of the sound source is 180° to 225° and 315° to 360°, and assume $\theta_e = \theta_{LR}$;

if $|ITD_{LCL}| > |ITD_{RCL}|/r_2$, the sound source is located behind, or if $|ITD_{LCL}| < |ITD_{RCL}|/r_2$, the sound source is located in front;

when $-1 \le m \le -\sqrt{2}/2$, the corresponding azimuth of the sound source is 225° to 315°, and assume $\theta_e = \theta_{LCL}$;

if $|ITD_{LCL}| > |ITD_{RCL}|/r_2$, the sound source is located behind, or if $|ITD_{LCL}| < |ITD_{RCL}|/r_2$, the sound source is located in front;

when m<−1, assume $\theta_e = \theta_{LCL}$;

if $|ITD_{LCL}| > |ITD_{RCL}|/r_2$, the sound source is located behind, or if $|ITD_{LCL}| < |ITD_{RCL}|/r_2$, the sound source is located in front.

Step 4: When it is determined that the sound source is located in front of the terminal device, the signal received on channel CL is a target signal, orientation enhancement processing is performed on the signal received on channel CL, and a left output signal and a right output signal of the terminal device are obtained according to the signal in channel CL after the orientation enhancement processing; when it is determined that the sound source is located in another position of the terminal device, the signal received on channel L may be directly output as a left-ear output signal, and the signal received on channel R is output as a right-ear output signal. When the sound source is located in front of the terminal device, a specific processing procedure is as follows:

$$L' = L + \sum_{i=1}^{N} a_i \times GA_i \times H_{bandi} \otimes CL,$$

$$R' = R + \sum_{i=1}^{N} b_i \times GA_i \times H_{bandi} \otimes CL$$

where the signal received on channel R is R, the signal received on channel L is L, the signal received on channel CL is CL, the right-ear output signal is R', and the left-ear output signal is L'; ⊗ indicates a convolution of two signals, so as to implement a filter function; $H_{low}$ indicates a low-pass filter whose cut-off frequency is $F_1$; $H_{bandi}$ indicates a band-pass filter, and a passband of the filter is $[F_i\ F_{i+1}]$; $GA_i$ indicates a filter gain coefficient when a gain adjustment is performed on the signal in channel C; $a_i$ and $b_i$ indicate amplitude ratio control factors when a gain adjustment is performed on the signal in the side channel;

$$a_i^2 + b_i^2 = 1, \text{ and } \frac{a_i}{b_i} = \frac{|H_{bandi} \otimes L|}{|H_{bandi} \otimes R|}.$$

Introduction of the amplitude ratio control factors means that when an amplitude adjustment is performed on different frequency bands of the signal in the side channel, the adjustment is performed according to an amplitude relationship between signals in frequency bands corresponding to the left and right channel signals. It should be understood that, the ratio control factors may also be obtained in other forms.

For example, $a_i+b_i=1$, and $$\frac{a_i}{b_i}=\frac{|H_{bandi}\otimes L|^2}{|H_{bandi}\otimes R|^2}.$$

In this embodiment, N=5, representing that the signal received on each channel is divided into five characteristic frequency bands in a same division manner, and is specifically divided into the following frequencies: $F_1$=3 kHz, $F_2$=8 kHz, $F_3$=10 kHz, $F_4$=12 kHz, $F_5$=17 kHz, and $F_6$=20 kHz. A gain coefficient of each characteristic frequency band is as follows: $GA_1$=1.2, $GA_2$=−0.5, $GA_3$=1.3, $GA_4$=−0.5, and $GA_5$=1.2 By using $GA_i$, different gain adjustments are performed on different frequency bands of the signal in the center channel. After amplitude gain adjustments are performed on the three characteristic frequency bands $H_{band1}$, $H_{band3}$, and $H_{band5}$ in which there are obvious differences between front and rear spectral amplitudes and in which a front response is far higher than a rear response, and after amplitude attenuation (suppression) adjustments are performed on the two characteristic frequency bands $H_{band2}$ and $H_{band4}$ in which there are obvious differences between front and rear spectral amplitudes and in which a rear response is far higher than a front response, adjusted signals are respectively added to corresponding frequency band signals in the left and right channels, so that differences between front and rear spectral amplitudes of the output signals of the left and right channels are enhanced.

It should be understood that, the division of the front and rear characteristic frequency bands and selection of the gain coefficient of each frequency band are based on an increase of a difference between a front spectrum and a rear spectrum, but this difference should not be exaggerated excessively, so as to avoid an apparent timbre distortion. The present invention is not limited to the specific numeric values of gain coefficients and division of frequency bands. It should also be understood that, according to different relative positions of the receiving channels, there are corresponding calculation methods for determining the orientation of the sound source relative to the terminal device, but the present invention is not limited to the specific calculation formulas.

It should also be understood that, the left-side channel CL in this embodiment of the present invention is only an example, and signal collection and processing may also be performed on side channels in other positions between the left channel and the right channel according to the method shown in the embodiment in FIG. 3, but the present invention is not limited to this.

Optionally, in an embodiment of the present invention, in step 4, when it is determined that the sound source is located in front of the terminal device, all the signal received on channel CL, the signal received on channel L, and the signal received on channel R are target signals, orientation enhancement processing is performed on the signal received on channel CL, orientation enhancement processing is performed on the signals received on channel R and channel L, a left output signal of the terminal device is obtained according to the signal in channel C after the orientation enhancement processing and the signal in channel L after the orientation enhancement processing, and a right output signal of the terminal device is obtained according to the signal in channel C after the orientation enhancement processing and the signal in channel R after the orientation enhancement processing; when it is determined that the sound source is located in another position of the terminal device, the signal received on the left channel is output as a left-ear output signal, and the signal received on the right channel is output as a right-ear output signal. When the sound source is located in front of the terminal device, a specific processing procedure is as follows:

$$L'=G_1\times H_{low}\otimes L+\sum_{i=1}^{N}G_{i+1}\times H_{bandi}\otimes L+\sum_{i=1}^{N}a_i\times GA_i\times H_{bandi}\otimes CL,$$

$$R'=G_1\times H_{low}\otimes R+\sum_{i=1}^{N}G_{i+1}\times H_{bandi}\otimes R+\sum_{i=1}^{N}b_i\times GA_i\times H_{bandi}\otimes CL$$

where the signal received on channel R is R, the signal received on channel L is L, the signal received on channel C is C, the right-ear output signal is R', and the left-ear output signal is L'; ⊗ indicates a convolution of two signals, so as to implement a filter function; $H_{low}$ indicates a low-pass filter whose cut-off frequency is $F_1$; $H_{bandi}$ indicates a band-pass filter, and a passband of the filter is $[F_i\ F_{i+1}]$; $G_i$ indicates a filter gain coefficient when a gain adjustment is performed on the signals in channels L and R, $GA_i$ indicates a filter gain coefficient when a gain adjustment is performed on the signal in channel C, and $a_i$ and $b_i$ indicate amplitude ratio control factors when a gain adjustment is performed on the signal in the side channel;

$$a_i^2+b_i^2=1,\text{ and }\frac{a_i}{b_i}=\frac{|H_{bandi}\otimes L|}{|H_{bandi}\otimes R|}.$$

Introduction of the amplitude ratio control factors means that when an amplitude adjustment is performed on different frequency bands of the signal in the side channel, the adjustment is performed according to an amplitude relationship between signals in frequency bands corresponding to the left and right channel signals. It should be understood that, the ratio control factors may also be obtained in other forms.

For example, $a_i+b_i=1$, and $$\frac{a_i}{b_i}=\frac{|H_{bandi}\otimes L|^2}{|H_{bandi}\otimes R|^2}.$$

In this embodiment, N=5, $F_1$=3 kHz, $F_2$=8 kHz, $F_3$=10 kHz, $F_4$=12 kHz, $F_5$=17 kHz, $F_6$=20 kHz, $G_1$=1, $G_2$=2, $G_3$=0.5, $G_4$=2, $G_5$=0.5, $G_6$=2, $GA_1$=1.2, $GA_2$=−0.5, $GA_3$=1.3, $GA_4$=−0.5, and $GA_5$=1.2. $G_i$=2 indicates a 6 dB spectral amplitude gain. $G_i$=0.5 indicates a 3 dB spectral amplitude attenuation. By using $G_i$, different gain adjustments are performed on different frequency bands of the signals received on channels R and L. By using $GA_i$, different gain adjustments are performed on different frequency bands of the signal received on channel C. After amplitude gain adjustments are performed on the three characteristic frequency bands $H_{band1}$, $H_{band3}$, and $H_{band5}$ in which there are obvious differences between front and rear spectral amplitudes and in which a front response is far higher than a rear response, and after amplitude attenuation (suppression) adjustments are performed on the two characteristic frequency bands $H_{band2}$ and $H_{band4}$ in which there are obvious differences between front and rear spectral amplitudes and in which a rear response is far higher than a front response, adjusted signals are respectively added to corresponding adjusted frequency band signals received on channels R and L, so that differences between front and rear spectral amplitudes of the output signals of the left and right channels are enhanced.

It should be understood that, the division of the front and rear characteristic frequency bands and selection of the gain coefficient of each frequency band are based on an increase of a difference between a front spectrum and a rear spectrum, but this difference should not be exaggerated excessively, so as to avoid an apparent timbre distortion. The present invention is not limited to the specific gain coefficients and division of frequency bands.

Optionally, in an embodiment of the present invention, in step 4, when it is determined that the sound source is located in front of the terminal device, all the signal received on channel CL, the signal received on channel L, and the signal received on channel R are target signals, orientation enhancement processing is performed on the signal received on channel CL, orientation enhancement processing is performed on the signals received on channel R and channel L, a left output signal of the terminal device is obtained according to the signal in channel C after the orientation enhancement processing, the signal in channel L after the orientation enhancement processing, and the original signal received on channel L, and a right output signal of the terminal device is obtained according to the signal in channel C after the orientation enhancement processing, the signal in channel R after the orientation enhancement processing, and the original signal received on channel R; when it is determined that the sound source is located in another position of the terminal device, the signal received on the left channel is output as a left-ear output signal, and the signal received on the right channel is output as a right-ear output signal. When the sound source is located in front of the terminal device, a specific processing procedure is as follows:

$$L' = L + G_1 \times H_{low} \otimes L + \sum_{i=1}^{N} G_{i+1} \times H_{bandi} \otimes L + \sum_{i=1}^{N} a_i \times GA_i \times H_{bandi} \otimes CL,$$

$$R' = R + G_1 \times H_{low} \otimes R + \sum_{i=1}^{N} G_{i+1} \times H_{bandi} \otimes R + \sum_{i=1}^{N} b_i \times GA_i \times H_{bandi} \otimes CL$$

where the signal received on channel R is R, the signal received on channel L is L, the signal received on channel C is C, the right-ear output signal is R', and the left-ear output signal is L'; $\otimes$ indicates a convolution of two signals, so as to implement a filter function; $H_{low}$ indicates a low-pass filter whose cut-off frequency is $F_1$; $H_{bandi}$ indicates a band-pass filter, and a passband of the filter is $[F_i\ F_{i+1}]$; $G_i$ indicates a filter gain coefficient when a gain adjustment is performed on the signals in channels L and R, $GA_i$ indicates a filter gain coefficient when a gain adjustment is performed on the signal in channel C, and $a_i$ and $b_i$ indicate amplitude ratio control factors when a gain adjustment is performed on the signal in the side channel;

$$a_i^2 + b_i^2 = 1, \text{ and } \frac{a_i}{b_i} = \frac{|H_{bandi} \otimes L|}{|H_{bandi} \otimes R|}.$$

Introduction of the amplitude ratio control factors means that when an amplitude adjustment is performed on different frequency bands of the signal in the side channel, the adjustment is performed according to an amplitude relationship between signals in frequency bands corresponding to the left and right channel signals. It should be understood that, the ratio control factors may also be obtained in other forms.

For example, $a_i+b_i=1$, and $$\frac{a_i}{b_i} = \frac{|H_{bandi} \otimes L|^2}{|H_{bandi} \otimes R|^2}.$$

In this embodiment, N=5, $F_1$=3 kHz, $F_2$=8 kHz, $F_3$=10 kHz, $F_4$=12 kHz, $F_5$=17 kHz, $F_6$=20 kHz, $G_1$=1, $G_2$=2, $G_3$=0.5, $G_4$=2, $G_5$=0.5, $G_6$=2, $GA_1$=1.2, $GA_2$=−0.5, $GA_3$=1.3, $GA_4$=−0.5, and $GA_5$=1.2. $G_i$=2 indicates a 6 dB spectral amplitude gain. $G_i$=0.5 indicates a 3 dB spectral amplitude attenuation. By using $G_i$, different gain adjustments are performed on different frequency bands of the signals received on channels R and L. By using $GA_i$, different gain adjustments are performed on different frequency bands of the signal received on channel C. After amplitude gain adjustments are performed on the three characteristic frequency bands $H_{band1}$, $H_{band3}$, and $H_{band5}$ in which there are obvious differences between front and rear spectral amplitudes and in which a front response is far higher than a rear response, and after amplitude attenuation (suppression) adjustments are performed on the two characteristic frequency bands $H_{band2}$ and $H_{band4}$ in which there are obvious differences between front and rear spectral amplitudes and in which a rear response is far higher than a front response, adjusted signals are respectively added to corresponding adjusted frequency band signals received on channels R and L, so that differences between front and rear spectral amplitudes of the output signals of the left and right channels are enhanced.

It should be understood that, the division of the front and rear characteristic frequency bands and selection of the gain coefficient of each frequency band are based on an increase of a difference between a front spectrum and a rear spectrum, but this difference should not be exaggerated excessively, so as to avoid an apparent timbre distortion. The present invention is not limited to the specific gain coefficients and division of frequency bands.

In the foregoing four steps in the embodiments of the present invention, a position of a sound source relative to a terminal device is determined, orientation enhancement processing is performed on a target signal emit by the sound source, and an output signal of the terminal device is obtained according to a result of the orientation enhancement processing, so that a degree of discrimination between a front characteristic frequency band and a rear characteristic frequency band of the output signal is increased. Therefore, perception of a sound image orientation of an output signal can be enhanced, and a probability of incorrectly determining a front sound image as a rear sound image is reduced.

Figure 4:
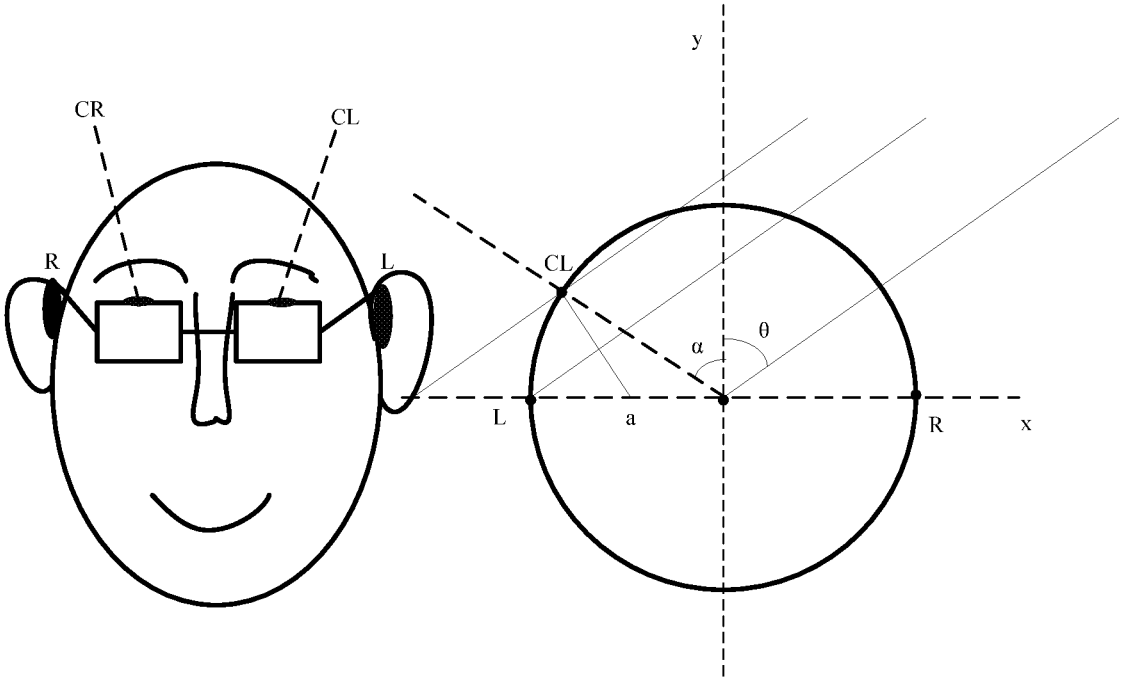
FIG. 4 is a schematic structural diagram of a terminal device according to still another embodiment of the present invention.

FIG. 4 is a schematic structural diagram of a terminal device according to another embodiment of the present invention. As shown in FIG. 4, the terminal device is a head-mounted multimedia system, and four channels located in different positions of the terminal device, namely, a left channel (channel L), a right channel (channel R), a center-left channel (channel CL), and a center-right channel (CR), are used to collect sound signals, where channel CL and channel CR belong to a first type of channel. In this embodiment of the present invention, signals received on one or two channels in the first type of channel may be used as target signals for orientation enhancement processing, and a left-ear output signal and a right-ear output signal are obtained according to a result of the orientation enhancement processing. It should be understood that, the present invention is not limited to the case of adding channel CL and channel CR, but other one or more channels may be added in other positions, and the four channels are merely used as an example for description in this embodiment of the present invention.

A right diagram in FIG. 4 shows a simplified schematic diagram of the terminal device. The positions in which channel R, channel L, and channel CL are located are simplified as a circle with a radius of a, where an origin of coordinates is O, an included angle between an incident direction and a y-axis is θ, an included angle between channel CL and the y-axis is α, and a coordinate system is established clockwise. In this case, the front is directly θ=0°, the right directly corresponds to θ=90°, and the left directly corresponds to θ=270°.

Step 1: Collect signals received on channel L, channel R, and channel CL.

Step 2: Measure a delay difference between every two of the signals received on channel L, channel R, and channel CL. A frequency domain related method is used to measure the delay difference between every two of the signals. The formula (1) may be used to obtain a delay difference $ITD_{LCL}$ between the signal received on channel L and the signal received on channel CL, a delay difference $ITD_{RCL}$ between the signal received on channel R and the signal received on channel CL, and a delay difference $ITD_{LR}$ between the signal received on channel L and the signal received on channel R. It should be understood that, the signal delay difference between every two of the signals received on the three channels may also be obtained according to a position relationship between channel R, channel L, and channel RL, and a position of a sound source relative to a terminal device is determined. Specifically, other manners may also be used in the method for measuring the delay differences between the signals in the channels, but the present invention is not limited to this.

When the head is unblocked, an incident direction of a sound source may be determined by using the delay differences between the signals received on channels L, R, and CL:

$$\theta_{LR} = \arcsin\left(\frac{c \cdot ITD_{LR}}{2a}\right) \tag{8}$$

Likewise, the following may be obtained:

$$\theta_{LCL} = \arcsin\left(\frac{c \cdot ITD_{LCL}}{2a \times r_1}\right) - \left(45 + \frac{\alpha}{2}\right),\ r_1 = \sin\left(\frac{90-\alpha}{2}\right) \tag{9}$$

-continued $$\theta_{RCL} = \left(45 + \frac{\alpha}{2}\right) - \arcsin\left(\frac{c \cdot ITD_{RCL}}{2a \times r_2}\right),\ r_2 = \cos\left(\frac{90-\alpha}{2}\right) \tag{10}$$

Step 3: Determine a position of a sound source relative to a terminal device. First, calculate $\theta_{LR}$, $\theta_{LCL}$, and $\theta_{RCL}$ by using the formula (8) to the formula (10). Then, using the frequency domain related measurement method shown in the formula (1), determine $ITD_{LCL}$, $ITD_{RCL}$, and $ITD_{LR}$.

Specifically, assume $$\frac{c \cdot ITD_{LR}}{2a} = m.$$

When m is greater than 0, it indicates that the sound source is located on a right half plane. In this case:

when $0 \le m < \sqrt{2}/2$, an azimuth of the sound source is in a range of 0° to 45° or 135° to 180°, and assume $\theta_e = \theta_{LR}$;

if $|ITD_{LCL}|/r_1 > |ITD_{RCL}|$, the sound source is located in front, or if $|ITD_{LCL}|/r_1 < |ITD_{RCL}|$, the sound source is located behind;

when $\sqrt{2}/2 \le m \le 1$, the corresponding azimuth of the sound source is 45° to 135°, and assume $\theta_e = \theta_{RCL}$;

if $|ITD_{LCL}|/r_1 > |ITD_{RCL}|$, the sound source is located in front, or if $|ITD_{LCL}|/r_1 < |ITD_{RCL}|$, the sound source is located behind;

when $m >^1$, assume $\theta_e = \theta_{RCL}$;

if $|ITD_{LCL}|/r_1 > |ITD_{RCL}|$, the sound source is located in front, or if $|ITD_{LCL}|/r_1 < |ITD_{RCL}|$, the sound source is located behind.

When m is less than 0, it indicates that the sound source is located on a left half plane. In this case:

when $-\sqrt{2}/2 < m < 0$, the corresponding azimuth of the sound source is 180° to 225° and 315° to 360°, and assume $\theta_e = \theta_{LR}$;

if $|ITD_{LCL}| > |ITD_{RCL}|/r_2$, the sound source is located behind, or if $|ITD_{LCL}| < |ITD_{RCL}|/r_2$, the sound source is located in front;

when $-1 \le m \le -\sqrt{2}/2$, the corresponding azimuth of the sound source is 225° to 315°, and assume $\theta_e = \theta_{LCL}$;

if $|ITD_{LCL}| > |ITD_{RCL}|/r_2$, the sound source is located behind, or if $|ITD_{LCL}| < |ITD_{RCL}|/r_2$, the sound source is located in front;

$m < -1$ when $\theta_e = \theta_{LCL}$, assume $\theta_e = \theta_{LCL}$;

if $|ITD_{LCL}| > |ITD_{RCL}|/r_2$, the sound source is located behind, or if $|ITD_{LCL}| < |ITD_{RCL}|/r_2$, the sound source is located in front.

Step 4: When it is determined that the sound source is located in front of the terminal device, the signal received on channel CL is a target signal, orientation enhancement processing is performed on the signal received on channel CL, and a left output signal and a right output signal of the terminal device are obtained according to the signal in channel CL after the orientation enhancement processing; or the signal received on channel L, the signal received on channel R, and the signal received on channel CL may be target signals, orientation enhancement processing is performed on the signals, and a left output signal and a right output signal of the terminal device are obtained according to the signal received on channel L, the signal received on channel R, and the signal in channel CL after the orientation enhancement processing; when it is determined that the sound source is located in another position of the terminal device, the signal received on channel L may be directly output as a left-ear output signal, and the signal received on channel R is output as a right-ear output signal. When the sound source is located in front of the terminal device, a specific processing procedure may be as follows:

$$L' = L + \sum_{i=1}^{N} a_i \times GA_i \times H_{bandi} \otimes CL,$$

$$R' = R + \sum_{i=1}^{N} b_i \times GA_i \times H_{bandi} \otimes CL; \text{ or}$$

$$L' = G_1 \times H_{low} \otimes L + \sum_{i=1}^{N} G_{i+1} \times H_{bandi} \otimes L + \sum_{i=1}^{N} a_i \times GA_i \times H_{bandi} \otimes CL,$$

$$R' = G_1 \times H_{low} \otimes R + \sum_{i=1}^{N} G_{i+1} \times H_{bandi} \otimes R + \sum_{i=1}^{N} b_i \times GA_i \times H_{bandi} \otimes CL;$$

or $$L' = L + G_1 \times H_{low} \otimes L + \sum_{i=1}^{N} G_{i+1} \times H_{bandi} \otimes L + \sum_{i=1}^{N} a_i \times GA_i \times H_{bandi} \otimes CL,$$

$$R' = R + G_1 \times H_{low} \otimes R + \sum_{i=1}^{N} G_{i+1} \times H_{bandi} \otimes R + \sum_{i=1}^{N} b_i \times GA_i \times H_{bandi} \otimes CL;$$

where the signal received on channel R is R, the signal received on channel L is L, the signal received on channel CL is CL, the right-ear output signal is R', and the left-ear output signal is L'; $\otimes$ indicates a convolution of two signals, so as to implement a filter function; $H_{low}$ indicates a low-pass filter whose cut-off frequency is $F_1$; $H_{bandi}$ indicates a band-pass filter, and a passband of the filter is $[F_i\ F_{i+1}]$; $GA_i$ indicates a filter gain coefficient when a gain adjustment is performed on the signal in channel C; $a_i$ and $b_i$ indicate amplitude ratio control factors when a gain adjustment is performed on a signal in a side channel;

$$a_i^2 + b_i^2 = 1, \text{ and } \frac{a_i}{b_i} = \frac{|H_{bandi} \otimes L|}{|H_{bandi} \otimes R|}.$$

Introduction of the amplitude ratio control factors means that when an amplitude adjustment is performed on different frequency bands of the signal in the side channel, the adjustment is performed according to an amplitude relationship between signals in frequency bands corresponding to the left and right channel signals. It should be understood that, the ratio control factors may also be obtained in other forms.

For example, $a_i+b_i=1$, and $$\frac{a_i}{b_i} = \frac{|H_{bandi} \otimes L|^2}{|H_{bandi} \otimes R|^2}.$$

In this embodiment, N=5, representing that the signal received on each channel is divided into five characteristic frequency bands in a same division manner, and is specifically divided into the following frequencies: $F_1$=3 kHz, $F_2$=8 kHz, $F_3$=10 kHz, $F_4$=12 kHz, $F_5$=17 kHz, and $F_6$=20 kHz. A gain coefficient of each characteristic frequency band is as follows: $GA_1$=1.2, $GA_2$=−0.5, $GA_3$=1.3, $GA_4$=−0.5, and $GA_5$=1.2 By using $GA_i$, different gain adjustments are performed on different frequency bands of the signal in the center channel. After amplitude gain adjustments are performed on the three characteristic frequency bands $H_{band1}$, $H_{band3}$, and $H_{band5}$ in which there are obvious differences between front and rear spectral amplitudes and in which a front response is far higher than a rear response, and after amplitude attenuation (suppression) adjustments are performed on the two characteristic frequency bands $H_{band2}$ and $H_{band4}$ in which there are obvious differences between front and rear spectral amplitudes and in which a rear response is far higher than a front response, adjusted signals are respectively added to corresponding frequency band signals in the left and right channels, so that differences between front and rear spectral amplitudes of the output signals of the left and right channels are enhanced.

It should be understood that, the division of the front and rear characteristic frequency bands and selection of the gain coefficient of each frequency band are based on an increase of a difference between a front spectrum and a rear spectrum, but this difference should not be exaggerated excessively, so as to avoid an apparent timbre distortion. The present invention is not limited to the specific numeric values of gain coefficients and division of frequency bands. It should also be understood that, according to different relative positions of the receiving channels, there are corresponding calculation methods for determining the orientation of the sound source relative to the terminal device, but the present invention is not limited to the specific calculation formulas.

Optionally, in an embodiment, in step 4, when it is determined that the sound source is located in front of the terminal device, the signal received on channel CL is a target signal, orientation enhancement processing is performed on the signal received on channel CL, and a left output signal and a right output signal of the terminal device are obtained according to the signal in channel CL after the orientation enhancement processing; or the signal received on channel L, the signal received on channel R, and the signal received on channel CL may be target signals, orientation enhancement processing is performed on the signals, and a left output signal and a right output signal of the terminal device are obtained according to the signal received on channel L, the signal received on channel R, and the signal in channel CL after the orientation enhancement processing; when it is determined that the sound source is located in another position of the terminal device, the signal received on channel L may be directly output as a left-ear output signal, and the signal received on channel R is output as a right-ear output signal. When the sound source is located in front of the terminal device, a specific processing procedure is as follows:

$$L' = L + \sum_{i=1}^{N} a_i \times GA_i \times H_{bandi} \otimes CR,$$

$$R' = R + \sum_{i=1}^{N} b_i \times GA_i \times H_{bandi} \otimes CR; \text{ or}$$

$$L' =$$

-continued $$G_1 \times H_{low} \otimes L + \sum_{i=1}^{N} G_{i+1} \times H_{bandi} \otimes L + \sum_{i=1}^{N} a_i \times GA_i \times H_{bandi} \otimes CR,$$

$$R' = G_1 \times H_{low} \otimes R + \sum_{i=1}^{N} G_{i+1} \times H_{bandi} \otimes R + \sum_{i=1}^{N} b_i \times GA_i \times H_{bandi} \otimes CR;$$

or $$L' = L + G_1 \times H_{low} \otimes L + \sum_{i=1}^{N} G_{i+1} \times H_{bandi} \otimes L + \sum_{i=1}^{N} a_i \times GA_i \times H_{bandi} \otimes CR,$$

$$R' = R + G_1 \times H_{low} \otimes R + \sum_{i=1}^{N} G_{i+1} \times H_{bandi} \otimes R + \sum_{i=1}^{N} b_i \times GA_i \times H_{bandi} \otimes CR;$$

where the signal received on channel R is R, the signal received on channel L is L, the signal received on channel CR is CR, the right-ear output signal is R', and the left-ear output signal is L'; $\otimes$ indicates a convolution of two signals, so as to implement a filter function; $H_{low}$ indicates a low-pass filter whose cut-off frequency is $F_1$; $H_{bandi}$ indicates a band-pass filter, and a passband of the filter is $[F_i\ F_{i+1}]$; $GA_i$ indicates a filter gain coefficient when a gain adjustment is performed on the signal in channel C; $a_i$ and $b_i$ indicate amplitude ratio control factors when a gain adjustment is performed on a signal in a side channel;

$$a_i^2 + b_i^2 = 1, \text{ and } \frac{a_i}{b_i} = \frac{|H_{bandi} \otimes L|}{|H_{bandi} \otimes R|}.$$

Introduction of the amplitude ratio control factors means that when an amplitude adjustment is performed on different frequency bands of the signal in the side channel, the adjustment is performed according to an amplitude relationship between signals in frequency bands corresponding to the left and right channel signals. It should be understood that, the ratio control factors may also be obtained in other forms.

For example, $a_i+b_i=1$, and $$\frac{a_i}{b_i} = \frac{|H_{bandi} \otimes L|^2}{|H_{bandi} \otimes R|^2}.$$

In this embodiment, N=5, representing that the signal received on each channel is divided into five characteristic frequency bands in a same division manner, and is specifically divided into the following frequencies: $F_1$=3 kHz, $F_2$=8 kHz, $F_3$=10 kHz, $F_4$=12 kHz, $F_5$=17 kHz, and $F_6$=20 kHz. A gain coefficient of each characteristic frequency band is as follows: $GA_1$=1.2, $GA_2$=−0.5, $GA_3$=1.3, $GA_4$=−0.5, and $GA_5$=1.2 By using $GA_i$, different gain adjustments are performed on different frequency bands of the signal in the center channel. After amplitude gain adjustments are performed on the three characteristic frequency bands $H_{band1}$, $H_{band3}$, and $H_{band5}$ in which there are obvious differences between front and rear spectral amplitudes and in which a front response is far higher than a rear response, and after amplitude attenuation (suppression) adjustments are performed on the two characteristic frequency bands $H_{band2}$ and $H_{band4}$ in which there are obvious differences between front and rear spectral amplitudes and in which a rear response is far higher than a front response, adjusted signals are respectively added to corresponding frequency band signals in the left and right channels, so that differences between front and rear spectral amplitudes of the output signals of the left and right channels are enhanced.

It should be understood that, the division of the front and rear characteristic frequency bands and selection of the gain coefficient of each frequency band are based on an increase of a difference between a front spectrum and a rear spectrum, but this difference should not be exaggerated excessively, so as to avoid an apparent timbre distortion. The present invention is not limited to the specific numeric values of gain coefficients and division of frequency bands. It should also be understood that, according to different relative positions of the receiving channels, there are corresponding calculation methods for determining the orientation of the sound source relative to the terminal device, but the present invention is not limited to the specific calculation formulas.

Optionally, in an embodiment, in step 4, when it is determined that the sound source is located in front of the terminal device, both the signals received on channels CL and CR are target signals, orientation enhancement processing is performed on the signal received on channel CR, orientation enhancement processing is also performed on the signal received on channel CL, and a left output signal and a right output signal of the terminal device are obtained according to the signal in channel CR after the orientation enhancement processing and the signal in channel CL after the orientation enhancement processing; or the signal received on channel L, the signal received on channel R, the signal received on channel CR, and the signal received on channel CL may be target signals, orientation enhancement processing is performed on the signals, and a left output signal and a right output signal of the terminal device are obtained according to the signal received on channel L, the signal received on channel R, the signal received on channel CR, and the signal in channel CL after the orientation enhancement processing; when the sound source is located in another position of the terminal device, the signal received on channel L may be directly output as a left-ear output signal, and the signal received on channel R is output as a right-ear output signal. When the sound source is located in front of the terminal device, a specific processing procedure is as follows:

$$L' = L + \sum_{i=1}^{N} a_i \times GA_i \times H_{bandi} \otimes CR + \sum_{i=1}^{N} a_i \times GA_i \times H_{bandi} \otimes CL,$$

$$R' = R + \sum_{i=1}^{N} b_i \times GA_i \times H_{bandi} \otimes CR + \sum_{i=1}^{N} b_i \times GA_i \times H_{bandi} \otimes CL;$$

or $$L' = G_1 \times H_{low} \otimes L + \sum_{i=1}^{N} G_{i+1} \times H_{bandi} \otimes L + \sum_{i=1}^{N} a_i \times GA_i \times H_{bandi} \otimes CR + \sum_{i=1}^{N} a_i \times GA_i \times H_{bandi} \otimes CL,$$

$$R' = G_1 \times H_{low} \otimes R + \sum_{i=1}^{N} G_{i+1} \times H_{bandi} \otimes R +$$

-continued $$\sum_{i=1}^{N} b_i \times GA_i \times H_{bandi} \otimes CR + \sum_{i=1}^{N} b_i \times GA_i \times H_{bandi} \otimes CL;$$

or $$L' = L + G_1 \times H_{low} \otimes L + \sum_{i=1}^{N} G_{i+1} \times H_{bandi} \otimes L + \sum_{i=1}^{N} a_i \times GA_i \times H_{bandi} \otimes CR + \sum_{i=1}^{N} a_i \times GA_i \times H_{bandi} \otimes CL,$$

$$R' = R + G_1 \times H_{low} \otimes R + \sum_{i=1}^{N} G_{i+1} \times H_{bandi} \otimes R + \sum_{i=1}^{N} b_i \times GA_i \times H_{bandi} \otimes CR + \sum_{i=1}^{N} b_i \times GA_i \times H_{bandi} \otimes CL;$$

where the signal received on channel R is R, the signal received on channel L is L, the signal received on channel CR is CR, the signal received on channel CL is CL, the right-ear output signal is R', and the left-ear output signal is L'; $\otimes$ indicates a convolution of two signals, so as to implement a filter function; $H_{low}$ indicates a low-pass filter whose cut-off frequency is $F_1$; $H_{bandi}$ indicates a band-pass filter, and a passband of the filter is $[F_i\ F_{i=1}]$; $GA_i$ indicates a filter gain coefficient when a gain adjustment is performed on the signal in channel C; $a_i$ and $b_i$ indicate amplitude ratio control factors when a gain adjustment is performed on a signal in a side channel;

$$a_i^2 + b_i^2 = 1, \text{ and } \frac{a_i}{b_i} = \frac{|H_{bandi} \otimes L|}{|H_{bandi} \otimes R|}.$$

Introduction of the amplitude ratio control factors means that when an amplitude adjustment is performed on different frequency bands of the signal in the side channel, the adjustment is performed according to an amplitude relationship between signals in frequency bands corresponding to the left and right channel signals. It should be understood that, the ratio control factors may also be obtained in other forms.

For example, $a_i+b_i=1$, and $$\frac{a_i}{b_i} = \frac{|H_{bandi} \otimes L|^2}{|H_{bandi} \otimes R|^2}.$$

In this embodiment, N=5, representing that the signal received on each channel is divided into five characteristic frequency bands in a same division manner, and is specifically divided into the following frequencies: $F_1$=3 kHz, $F_2$=8 kHz, $F_3$=10 kHz, $F_4$=12 kHz, $F_5$=17 kHz, and $F_6$=20 kHz. A gain coefficient of each characteristic frequency band is as follows: $GA_1$=1.2, $GA_2$=−0.5, $GA_3$=1.3, $GA_4$=−0.5, and $GA_5$=1.2 By using $GA_i$, different gain adjustments are performed on different frequency bands of the signal in the center channel. After amplitude gain adjustments are performed on the three characteristic frequency bands $H_{band1}$, $H_{band3}$, and $H_{band5}$ in which there are obvious differences between front and rear spectral amplitudes and in which a front response is far higher than a rear response, and after amplitude attenuation (suppression) adjustments are performed on the two characteristic frequency bands $H_{band2}$ and $H_{band4}$ in which there are obvious differences between front and rear spectral amplitudes and in which a rear response is far higher than a front response, adjusted signals are respectively added to corresponding frequency band signals in the left and right channels, so that differences between front and rear spectral amplitudes of the output signals of the left and right channels are enhanced.

It should be understood that, the division of the front and rear characteristic frequency bands and selection of the gain coefficient of each frequency band are based on an increase of a difference between a front spectrum and a rear spectrum, but this difference should not be exaggerated excessively, so as to avoid an apparent timbre distortion. The present invention is not limited to the specific numeric values of gain coefficients and division of frequency bands. It should also be understood that, according to different relative positions of the receiving channels, there are corresponding calculation methods for determining the orientation of the sound source relative to the terminal device, but the present invention is not limited to the specific calculation formulas.

It should also be understood that, the foregoing manners of combining target signals are only several preferred solutions, and this embodiment of the present invention does not illustrate all various possible combination manners.

Figure 5:
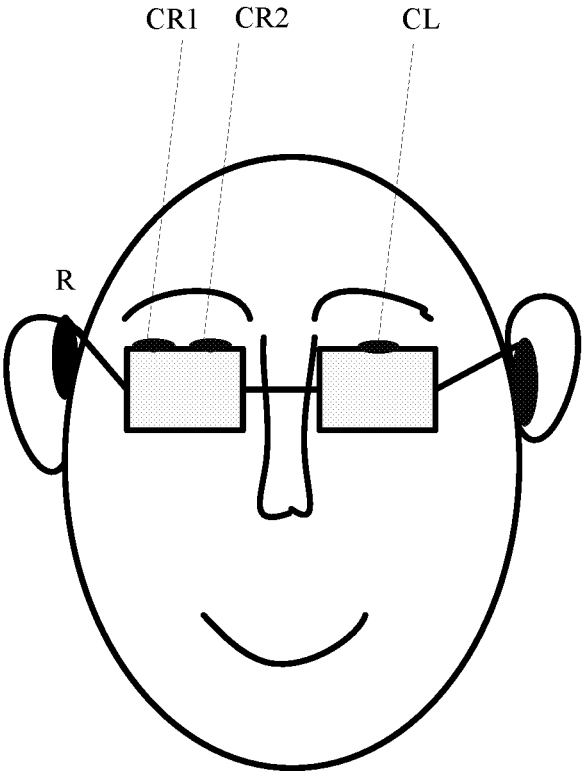
FIG. 5 is a schematic structural diagram of a terminal device according to another embodiment of the present invention.

FIG. 5 is a schematic structural diagram of a terminal device according to another embodiment of the present invention. As shown in FIG. 5, the terminal device is a head-mounted multimedia system, and five channels located in different positions of the terminal device, namely, a left channel (channel L), a right channel (channel R), a center-left channel (channel CL), a center-right channel 1 (channel CR1), and a center-right channel 2 (channel CR2), are used to collect sound signals. It should be understood that, the present invention is not limited to the case of adding channel C, channel CL, channel CR1, and channel CR2, but other channels may be added in other positions. In this embodiment of the present invention, only the five channels are used as an example for description.

Step 1: Collect signals received on channel L, channel R, channel CL, channel CR1, and channel CR2.

Step 2: Measure a delay difference between every two of the signals received on channel L, channel R, and channel CL; or measure a delay difference between every two of the signals received on channel L, channel R, and channel CR1; or measure a delay difference between every two of the signals received on channel L, channel R, and channel CR2. A frequency domain related method is used to obtain the delay difference between every two of the signals. A specific measurement method is similar to the methods shown in the embodiments in FIG. 2 to FIG. 4, and details are not described again herein.

Step 3: Determine a position of a sound source relative to a terminal device. A specific determining method is similar to the methods shown in the embodiments in FIG. 2 to FIG. 4, and details are not described again herein.

Step 4: When it is determined that the sound source is located in front of the terminal device, channel CR1, channel CR2, and channel CL belong to a first type of channel, and at least one of the signals received on channel CR1, channel CR2, and channel CL is selected as a target signal for orientation enhancement processing, where the signal after the orientation enhancement processing is a first type of processed signal; a left-ear output signal and a right-ear output signal may be obtained according to the first type of processed signal and the signals received on channel L and channel R, or a left-ear output signal and a right-ear output signal may be obtained according to the first type of processed signal and the signals received on channel L and channel R after the orientation enhancement processing. It should be understood that, channel CR1, channel CR2, and channel CL are only exemplary channels, and they belong to a same type of channel. This type of channel is located in front of channel R and channel L and is located between channel R and channel L. In specific application, a signal received on one or more channels in this type of channel may be selected as a target signal for orientation enhancement processing, and a left-ear output signal and a right-ear output signal may be obtained according to a result of the orientation enhancement processing. The present invention is not limited to this.

Figure 6:
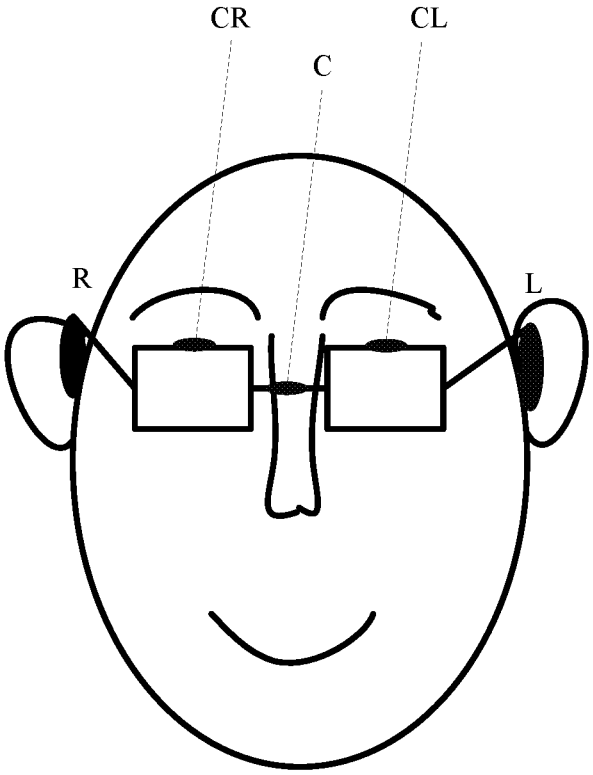
FIG. 6 is a schematic structural diagram of a terminal device according to still another embodiment of the present invention.

FIG. 6 is a schematic structural diagram of a terminal device according to another embodiment of the present invention. As shown in FIG. 6, the terminal device is a head-mounted multimedia system, and five channels located in different positions of the terminal device, namely, a left channel (channel L), a right channel (channel R), a center channel (channel C), and a center-right channel (channel CR), are used to collect sound signals. It should be understood that, the present invention is not limited to the case of adding channel C, channel CL, and channel CR, but other channels may be added in other positions. In this embodiment of the present invention, only the five channels are used as an example for description.

Step 1: Collect signals respectively received on channel L, channel R, channel C, channel CL, and channel CR.

Step 2: Measure a delay difference between every two of three signals in the signals respectively received on channel L, channel R, channel C, channel CL, and channel CR, and obtain the delay difference between every two of the three signals by using the formula (1). Positions of the channels receiving the three signals for determining the delay differences can form a triangular relationship. It should be understood that, specifically, other manners may also be used in the method for measuring the delay difference between every two of the signals in the channels, but the present invention is not limited to this.

Step 3: Determine a position of a sound source relative to a terminal device. This step is similar to the method for determining an orientation of a sound source relative to a terminal device in the foregoing embodiment, and details are not described again herein.

Step 4: When it is determined that the sound source is located in front of the terminal device, orientation enhancement processing is performed on the signal received on channel CL, channel CR, or channel C, and a left output signal and a right output signal of the terminal device are obtained according to the signal received on channel CL, channel CR, or channel C after the orientation enhancement processing; when it is determined that the sound source is located in another position of the terminal device, the signal received on channel L may be directly output as a left-ear output signal, and the signal received on channel R is output as a right-ear output signal. When the sound source is located in front of the terminal device, a specific processing procedure is as follows.

When $0°<\theta_e\leq 30°$ or $330°<\theta_e\leq 360°$, that is, when the sound source is located approximately directly in front of the terminal device, the signal received on the center channel C may be used as a target signal for processing, where an azimuth of the sound source is $\theta_e$. It should be understood that, $0°<\theta_e\leq 30°$ or $330°<\theta_e\leq 360°$ means that the sound source is located in an interval of the front. Specifically, left-ear and right-ear output signals may be obtained according to the following formula:

$$L' = L + \sum_{i=1}^{N} GA_i \times H_{bandi} \otimes C,$$

$$R' = R + \sum_{i=1}^{N} GA_i \times H_{bandi} \otimes C$$

where the signal received on channel R is R, the signal received on channel L is L, the signal received on channel C is C, the right-ear output signal is R', and the left-ear output signal is L'; $\otimes$ indicates a convolution of two signals, so as to implement a filter function; $H_{low}$ indicates a low-pass filter whose cut-off frequency is $F_1$; $H_{bandi}$ indicates a band-pass filter, and a passband of the filter is $[F_i\ F_{i+1}]$; $GA_i$ indicates a filter gain coefficient when a gain adjustment is performed on the signal in channel C. Orientation enhancement processing is performed on the signal received on channel C, and the left-ear and right-ear output signals are obtained according to the signal after the orientation enhancement processing. It should be understood that, orientation enhancement processing may also be performed on the signal R received on channel R, the signal L received on channel L, and the signal C received on channel C simultaneously, and the left-ear and right-ear output signals are obtained according to the signals after the orientation enhancement processing.

In this embodiment, N=5, $F_1$=3 kHz, $F_2$=8 kHz, $F_3$=10 kHz, $F_4$=12 kHz, $F_5$=17 kHz, $F_6$=20 kHz, $GA_1$=1.2, $GA_2$=−0.5, $GA_3$=1.3, $GA_4$=−0.5, and, $GA_5$=1.2. By using $GA_i$, different gain adjustments are performed on different frequency bands of the signal in the center channel. After amplitude adjustments are performed on the three characteristic frequency bands $H_{band1}$, $H_{band3}$, and $H_{band5}$ in which there are obvious differences between front and rear spectral intensities and in which a front response is far higher than a rear response, and after amplitude attenuation (suppression) adjustments are performed on the two characteristic frequency bands $H_{band2}$ and $H_{band4}$ in which there are obvious differences between front and rear spectral amplitudes and in which a rear response is far higher than a front response, adjusted signals are respectively added to corresponding frequency band signals in the left and right channels, so that differences between front and rear spectral amplitudes of the output signals of the left and right channels are enhanced.

It should be understood that, the division of the front and rear characteristic frequency bands and selection of the gain coefficient of each frequency band are based on an increase of a difference between a front spectrum and a rear spectrum, but this difference should not be exaggerated excessively, so as to avoid an apparent timbre distortion. The present invention is not limited to the specific gain coefficients and division of frequency bands.

When $30°<\theta_e\leq 90°$, the signal received on channel CR may be used as a target signal for processing, where an azimuth of the sound source is $\theta_e$. It should be understood that, $30°<\theta_e\leq 90°$ means that the sound source is located in an interval on a right side of the front. Specifically, left-ear and right-ear output signals may be obtained according to the following formula:

$$L' = L + \sum_{i=1}^{N} a_i \times GA_i \times H_{bandi} \otimes CR,$$

-continued $$R' = R + \sum_{i=1}^{N} b_i \times GA_i \times H_{bandi} \otimes CR$$

where the signal received on channel R is R, the signal received on channel L is L, the signal received on channel CR is CR, the right-ear output signal is R', and the left-ear output signal is L'; ⊗ indicates a convolution of two signals, so as to implement a filter function; $H_{low}$ indicates a low-pass filter whose cut-off frequency is $F_1$; $H_{bandi}$ indicates a band-pass filter, and a passband of the filter is $[F_i\ F_{i+1}]$; $GA_i$ indicates a filter gain coefficient when a gain adjustment is performed on the signal in channel CR; $a_i$ and $b_i$ indicate amplitude ratio control factors when a gain adjustment is performed on a signal in a side channel;

$$a_i^2 + b_i^2 = 1, \text{ and } \frac{a_i}{b_i} = \frac{|H_{bandi} \otimes L|}{|H_{bandi} \otimes R|}.$$

Introduction of the amplitude ratio control factors means that when an amplitude adjustment is performed on different frequency bands of the signal in the side channel, the adjustment is performed according to an amplitude ratio of signals in frequency bands corresponding to the left and right channel signals. It should be understood that, the ratio control factors may also be obtained in other forms.

For example, $a_i+b_i=1$, and $$\frac{a_i}{b_i} = \frac{|H_{bandi} \otimes L|^2}{|H_{bandi} \otimes R|^2}.$$

This is not limited in the present invention.

Orientation enhancement processing is performed on the signal received on channel CR, and the left-ear and right-ear output signals are obtained according to the signal after the orientation enhancement processing. It should be understood that, orientation enhancement processing may also be performed on the signal R received on channel R, the signal L received on channel L, and the signal CR received on channel CR simultaneously, and the left-ear and right-ear output signals are obtained according to the signals after the orientation enhancement processing.

In this embodiment, N=5, $F_1$=3 kHz, $F_2$=8 kHz, $F_3$=10 kHz, $F_4$=12 kHz, $F_5$=17 kHz, $F_6$=20 kHz, $GA_1$=1.2, $GA_2$=−0.5, $GA_3$=1.3, $GA_4$=−0.5, and, $GA_5$=1.2. By using $GA_i$, different gain adjustments are performed on different frequency bands of the signal in the center channel. After amplitude adjustments are performed on the three characteristic frequency bands $H_{band1}$, $H_{band3}$, and $H_{band5}$ in which there are obvious differences between front and rear spectral amplitudes and in which a front response is far higher than a rear response, and after amplitude attenuation (suppression) adjustments are performed on the two characteristic frequency bands $H_{band2}$ and $H_{band4}$ in which there are obvious differences between front and rear spectral amplitudes and in which a rear response is far higher than a front response, adjusted signals are respectively added to corresponding frequency band signals in the left and right channels, so that differences between front and rear spectral amplitudes of the output signals of the left and right channels are enhanced.

It should be understood that, the division of the front and rear characteristic frequency bands and selection of the gain coefficient of each frequency band are based on an increase of a difference between a front spectrum and a rear spectrum, but this difference should not be exaggerated excessively, so as to avoid an apparent timbre distortion. The present invention is not limited to the specific gain coefficients and division of frequency bands.

When $270° \le \theta_e < 330°$, the signal received on channel CR may be used as a target signal for processing, where an azimuth of the sound source is $\theta_e$. It should be understood that, $270° \le \theta_e < 330°$ means that the sound source is located in an interval on a left side of the front. Specifically, left-ear and right-ear output signals may be obtained according to the following formula:

$$L' = L + \sum_{i=1}^{N} a_i \times GA_i \times H_{bandi} \otimes CL,$$

$$R' = R + \sum_{i=1}^{N} b_i \times GA_i \times H_{bandi} \otimes CL$$

where the signal received on channel R is R, the signal received on channel L is L, the signal received on channel CL is CL, the right-ear output signal is R', and the left-ear output signal is L'; ⊗ indicates a convolution of two signals, so as to implement a filter function; $H_{low}$ indicates a low-pass filter whose cut-off frequency is $F_1$; $H_{bandi}$ indicates a band-pass filter, and a passband of the filter is $[F_i\ F_{i+1}]$; $GA_i$ indicates a filter gain coefficient when a gain adjustment is performed on the signal in channel CR; $a_i$ and $b_i$ indicate amplitude ratio control factors when a gain adjustment is performed on a signal in a side channel;

$$a_i^2 + b_i^2 = 1, \text{ and } \frac{a_i}{b_i} = \frac{|H_{bandi} \otimes L|}{|H_{bandi} \otimes R|}.$$

Introduction of the amplitude ratio control factors means that when an amplitude adjustment is performed on different frequency bands of the signal in the side channel, the adjustment is performed according to an amplitude ratio of signals in frequency bands corresponding to the left and right channel signals. It should be understood that, the ratio control factors may also be obtained in other forms.

For example, $a_i+b_i=1$, and $$\frac{a_i}{b_i} = \frac{|H_{bandi} \otimes L|^2}{|H_{bandi} \otimes R|^2}.$$

Orientation enhancement processing is performed on the signal received on channel CR, and the left-ear and right-ear output signals are obtained according to the signal after the orientation enhancement processing. It should be understood that, orientation enhancement processing may also be performed on the signal R received on channel R, the signal L received on channel L, and the signal CR received on channel CR simultaneously, and the left-ear and right-ear output signals are obtained according to the signals after the orientation enhancement processing.

In this embodiment, N=5, $F_1$=3 kHz, $F_2$=8 kHz, $F_3$=10 kHz, $F_4$=12 kHz, $F_5$=17 kHz, $F_6$=20 kHz, $GA_1$=1.2, $GA_2$=−

0.5, $GA_3$=1.3, $GA_4$=−0.5, and, $GA_5$=1.2. By using $GA_i$, different gain adjustments are performed on different frequency bands of the signal in the center channel. After amplitude adjustments are performed on the three characteristic frequency bands $H_{band1}$, $H_{band3}$, and $H_{band5}$ in which there are obvious differences between front and rear spectral intensities and in which a front response is far higher than a rear response, and after amplitude attenuation (suppression) adjustments are performed on the two characteristic frequency bands $H_{band2}$ and $H_{band4}$ in which there are obvious differences between front and rear spectral amplitudes and in which a rear response is far higher than a front response, adjusted signals are respectively added to corresponding frequency band signals in the left and right channels, so that differences between front and rear spectral amplitudes of the output signals of the left and right channels are enhanced.

It should be understood that, the division of the front and rear characteristic frequency bands and selection of the gain coefficient of each frequency band are based on an increase of a difference between a front spectrum and a rear spectrum, but this difference should not be exaggerated excessively, so as to avoid an apparent timbre distortion. The present invention is not limited to the specific gain coefficients and division of frequency bands.

It should also be understood that, dividing the front into three intervals in this embodiment of the present invention is only an example. The front may also be divided into intervals in other manners according to a quantity of channels of the terminal device and a position of an actual sound source. In addition, signals received on different channels may also be selected as target signals for orientation enhancement processing. Any combination manners may be feasible so long as it can enhance perception of a sound image orientation of an output signal and reduce a probability of incorrectly determining a front sound image signal as a rear sound image signal. The present invention is not limited to this.

Figure 7:
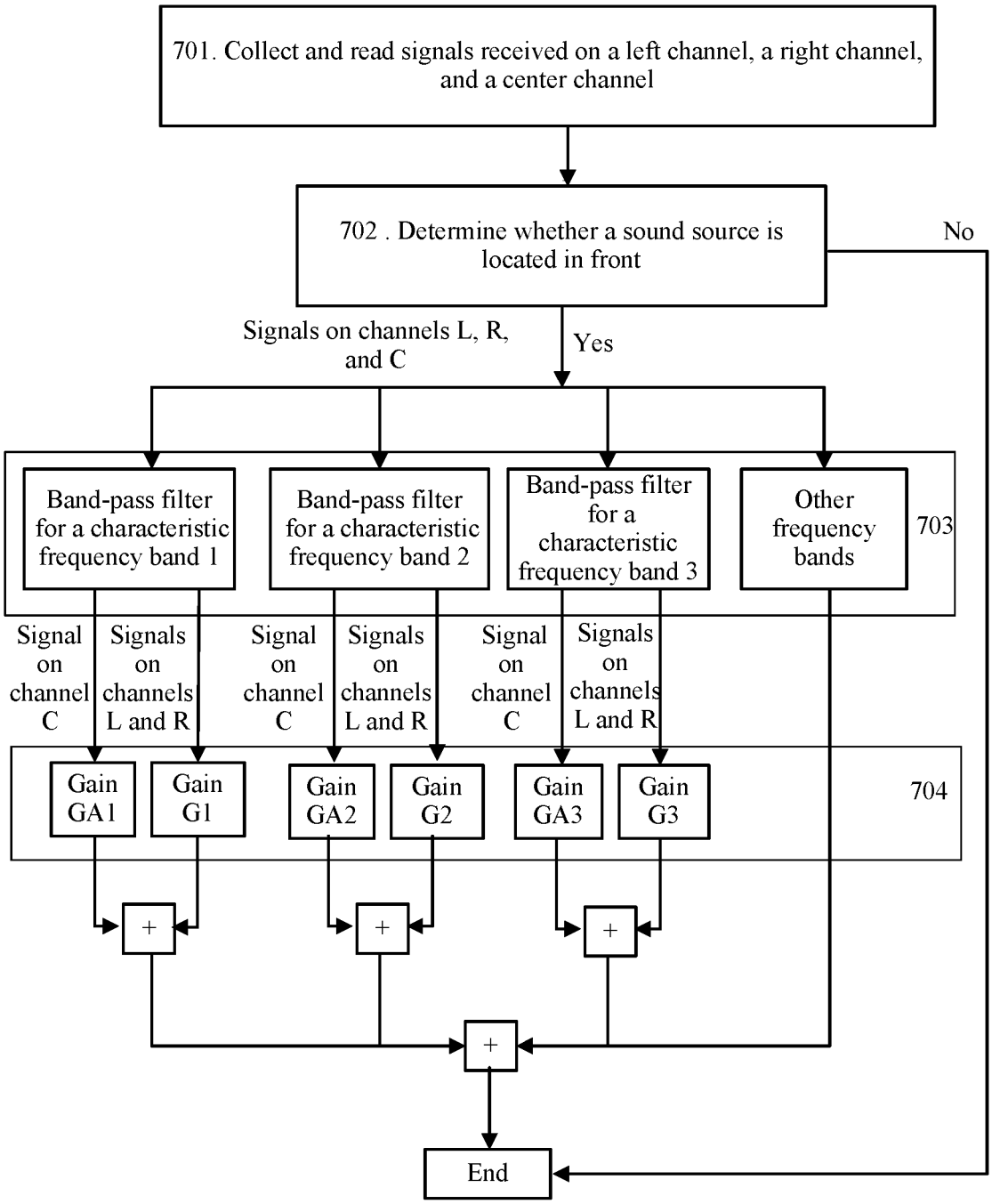
FIG. 7 is a schematic flowchart of a method for processing a sound signal according to another embodiment of the present invention.

FIG. 7 shows a schematic flowchart of a method for processing a sound signal according to another embodiment of the present invention.

Optionally, in an embodiment of the present invention, a multimedia head-mounted device having channel R, channel L, and channel C is used as an example, and an entire signal processing procedure is as follows.

Step 701: Collect and read signals received on a left channel, a right channel, and a center channel.

Step 702: Determine whether a sound source is located in front. The process includes determining a delay difference between every two of the signals received on channel R, channel L, and channel C, and determining an orientation of the sound source relative to a terminal device according to the delay difference between every two of the three signals. A method for determining the orientation is similar to the methods shown in FIG. 2 to FIG. 6, and details are not described again herein.

When the sound source is not located in front of the terminal device, no processing is performed on the collected sound signals. A left-ear output signal is the signal received on channel L, and a right-ear output signal is the signal received on channel R.

When the sound source is located in front of the terminal device, orientation enhancement processing is performed on a target signal in the received sound signals. In this embodiment of the present invention, the target signal is the signal received on channel C. A specific process is shown in step 703 and step 704. In step 703, the sound signals received on channels R, L, and C are divided into three front characteristic frequency bands 1, 2, and 3. Band-pass filtering is performed on the three front characteristic frequency bands, but no processing is performed on other frequency bands.

Step 704: Perform signal enhancement processing on the signal received on channel C in each characteristic frequency band, where specifically, a gain coefficient for the characteristic frequency band 1 is GA1, a gain coefficient for the characteristic frequency band 2 is GA2, and a gain coefficient for the characteristic frequency band 3 is GA3; and perform signal enhancement processing on the signals received on channel R and channel L in each frequency band, where a gain coefficient for the characteristic frequency band 1 is G1, a gain coefficient for the characteristic frequency band 2 is G2, and a gain coefficient for the characteristic frequency band 3 is G3.

A right-ear output signal is obtained according to the signal received on channel C after the orientation enhancement processing and the signal received on channel R after the orientation enhancement processing; a left-ear output signal is obtained according to the signal received on channel C after the orientation enhancement processing and the signal received on channel L after the orientation enhancement processing. The entire signal processing procedure is complete.

It should be understood that, in this embodiment of the present invention, signal suppression processing is further performed on a rear characteristic frequency band of the target signal in the sound source signals, so as to increase a degree of discrimination between the front characteristic frequency band and the rear characteristic frequency band of the signal, and achieve an effect of reducing front/rear sound image confusion and enhancing perception of a sound image orientation.

Figure 8:
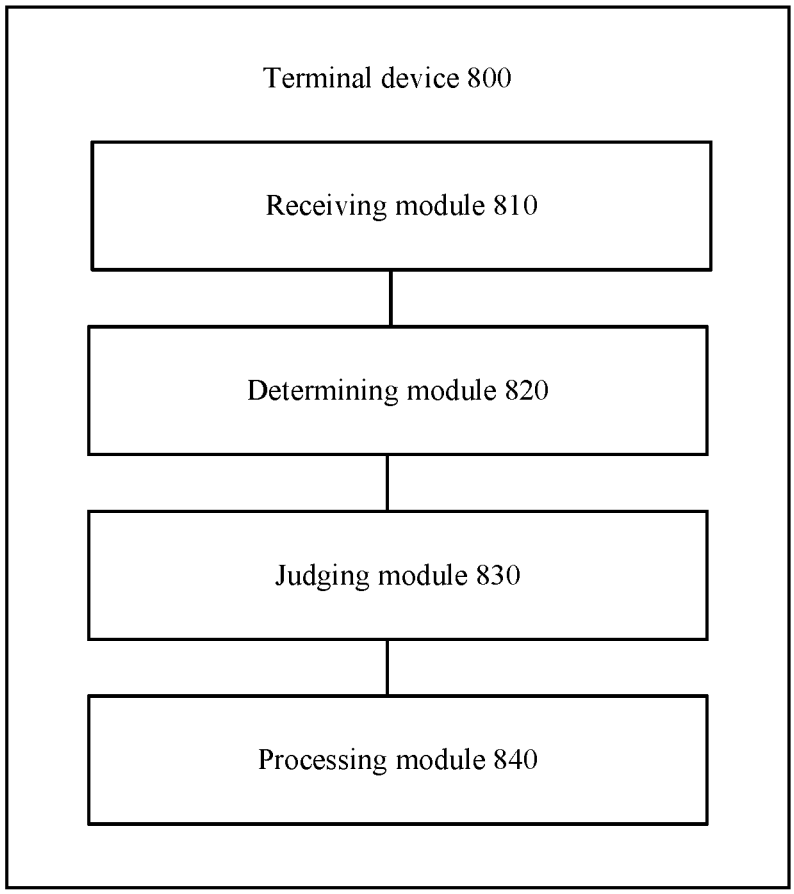
FIG. 8 is a schematic block diagram of a terminal device according to an embodiment of the present invention.
Figure 9:
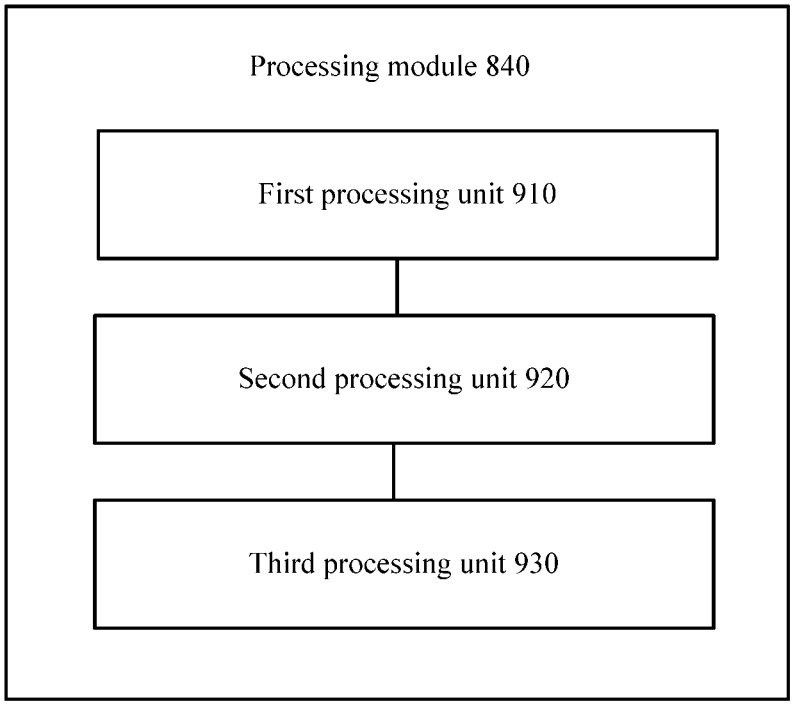
FIG. 9 is a schematic block diagram of a terminal device according to an embodiment of the present invention.
Figure 10:
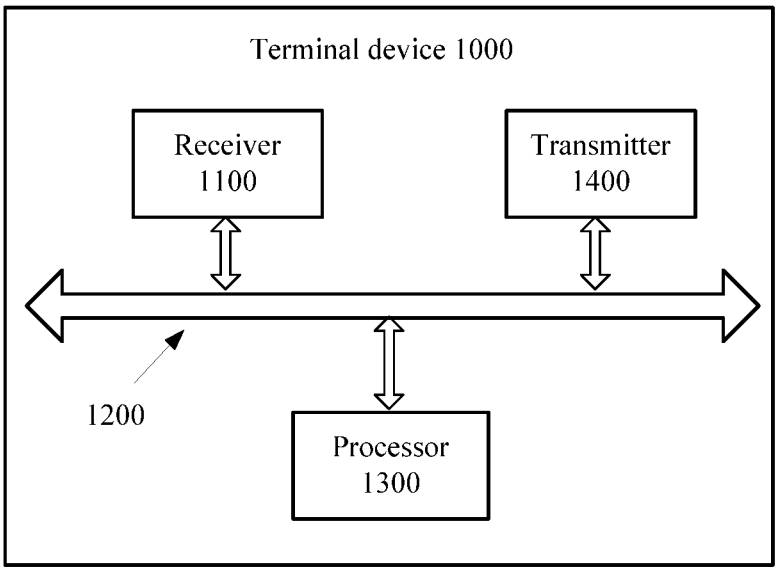
FIG. 10 is a schematic block diagram of a terminal device according to an embodiment of the present invention.

FIG. 1 to FIG. 7 describe a specific implementation process of the present invention from a perspective of a method implemented by a terminal device. FIG. 8 to FIG. 10 describe the terminal device from a perspective of an apparatus.

FIG. 8 is a schematic block diagram of a terminal device according to an embodiment of the present invention. The terminal device in FIG. 8 includes a receiving module 810, a determining module 820, a judging module 830, and a processing module 840.

The receiving module 810 includes at least three receiving channels located in different positions of the terminal device, and the at least three receiving channels are used to receive at least three signals emit by a same sound source, where the at least three signals are in a one-to-one correspondence to the channels.

The determining module 820 is configured to determine, according to three signals in the at least three signals received by the receiving module 810, a signal delay difference between every two of the three signals, where a position of the sound source relative to the terminal device can be determined according to the signal delay difference.

The judging module 830 is configured to determine, according to the signal delay difference obtained by the determining module 820, the position of the sound source relative to the terminal device.

The processing module 840 is configured to: when the judging module 830 determines that the sound source is located in front of the terminal device, perform orientation enhancement processing on a target signal in the at least three signals, and obtain a first output signal and a second output signal of the terminal device according to a result of the orientation enhancement processing, where the orientation enhancement processing is used to increase a degree of discrimination between a front characteristic frequency band and a rear characteristic frequency band of the target signal.

In this embodiment of the present invention, a position of a sound source relative to a terminal device is determined, orientation enhancement processing is performed on a target signal emit by the sound source, and an output signal of the terminal device is obtained according to a result of the orientation enhancement processing, so that a degree of discrimination between a front characteristic frequency band and a rear characteristic frequency band of the output signal is increased. Therefore, perception of a sound image orientation of an output signal can be enhanced, and a probability of incorrectly determining a front sound image as a rear sound image is reduced.

FIG. 9 is a schematic block diagram of a terminal device according to an embodiment of the present invention.

Optionally, in an embodiment, the receiving module 810 includes a first channel, a second channel, and a third channel, the at least three signals include a first signal received on the first channel, a second signal received on the second channel, and a third signal received on the third channel, the first channel is closer to the front than the second channel and the third channel, and the first channel is located between the second channel and the third channel. The processing module 840 includes a first processing unit 910 and a second processing unit 920. When the judging module 830 determines that the sound source is located in front of the terminal device, the first processing unit 910 is configured to perform the orientation enhancement processing on the first signal to obtain a first processed signal, where the first signal is the target signal. The second processing unit 920 is configured to obtain the first output signal according to the second signal and the first processed signal that is obtained by the first processing unit 910 and obtain the second output signal according to the third signal and the first processed signal that is obtained by the first processing unit 910.

Optionally, in an embodiment, the receiving module 810 includes a first channel, a second channel, and a third channel, the at least three signals include a first signal received on the first channel, a second signal received on the second channel, and a third signal received on the third channel, the first channel is closer to the front than the second channel and the third channel, and the first channel is located between the second channel and the third channel. The processing module 840 includes a first processing unit 910 and a second processing unit 920. When the judging module 830 determines that the sound source is located in front of the terminal device, the first processing unit 910 is configured to perform the orientation enhancement processing on the first signal to obtain a first processed signal, perform the orientation enhancement processing on the second signal to obtain a second processed signal, and perform the orientation enhancement processing on the third signal to obtain a third processed signal, where all the first signal, the second signal, and the third signal are the target signals. The second processing unit 920 is configured to obtain the first output signal according to the first processed signal and the second processed signal that are obtained by the first processing unit 910, and obtain the second output signal according to the first processed signal and the third processed signal that are obtained by the first processing unit 910.

Optionally, in an embodiment, the receiving module 810 includes a first channel, a second channel, and a third channel, the at least three signals include a first signal received on the first channel, a second signal received on the second channel, and a third signal received on the third channel, the first channel is closer to the front than the second channel and the third channel, and the first channel is located between the second channel and the third channel. The processing module 840 includes a first processing unit 910 and a second processing unit 920. When the judging module 830 determines that the sound source is located in front of the terminal device, the first processing unit 910 is configured to perform the orientation enhancement processing on the first signal to obtain a first processed signal, perform the orientation enhancement processing on the second signal to obtain a second processed signal, and perform the orientation enhancement processing on the third signal to obtain a third processed signal, where all the first signal, the second signal, and the third signal are the target signals. The second processing unit 920 is configured to obtain the first output signal according to the second signal, the first processed signal that is obtained by the first processing unit 910, and the second processed signal that is obtained by the first processing unit 910, and obtain the second output signal according to the third signal, the first processed signal that is obtained by the first processing unit 910, and the third processed signal that is obtained by the first processing unit 910.

Optionally, in an embodiment, the processing module 840 further includes a third processing unit 930, and the third processing unit 930 is configured to perform, according to a signal amplitude in each characteristic frequency band of the second signal and a signal amplitude in each characteristic frequency band of the third signal, an amplitude adjustment on each characteristic frequency band corresponding to the first processed signal obtained by the first processing unit 910, so as to obtain the first output signal and the second output signal, where the first processed signal, the second signal, and the third signal are divided into the characteristic frequency bands in a same manner.

Optionally, in an embodiment, the receiving module 810 includes a first type of channel, a second channel, and a third channel, the at least three signals include a first type of signal received on the first channel, a second signal received on the second channel, and a third signal received on the third channel, the first type of channel includes at least two channels, the at least two channels are respectively used to receive at least two signals, any channel in the first type of channel is closer to the front than the second channel and the third channel, and any channel in any channel in the first type of channel is located between the second channel and the third channel. The processing module 840 includes a first processing unit 910 and a second processing unit 920. When the judging module 830 determines that the sound source is located in front of the terminal device, the first processing unit 910 is configured to perform the orientation enhancement processing on at least one signal in the first type of signal to obtain a first type of processed signal, perform the orientation enhancement processing on the second signal to obtain a second processed signal, and perform the orientation enhancement processing on the third signal to obtain a third processed signal, where the at least one signal in the first type of signal is the target signal. The second processing unit 920 is configured to obtain the first output signal according to the second signal and the first type of processed signal that is obtained by the first processing unit 910, and obtain the second output signal according to the third signal and the first type of processed signal that is obtained by the first processing unit 910.

Optionally, in an embodiment, the receiving module 810 includes a first type of channel, a second channel, and a third channel, the at least three signals include a first type of signal received on the first channel, a second signal received on the second channel, and a third signal received on the third channel, the first type of channel includes at least two channels, the at least two channels are respectively used to receive at least two signals, any channel in the first type of channel is closer to the front than the second channel and the third channel, and any channel in the first type of channel is located between the second channel and the third channel. The processing module 840 includes a first processing unit 910 and a second processing unit 920. When the judging module 830 determines that the sound source is located in front of the terminal device, the first processing unit 910 is configured to perform the orientation enhancement processing on at least one signal in the first type of signal to obtain a first type of processed signal, perform the orientation enhancement processing on the second signal to obtain a second processed signal, and perform the orientation enhancement processing on the third signal to obtain a third processed signal, where the at least one signal in the first type of signal, the second signal, and the third signal are the target signals. The second processing unit 920 is configured to obtain the first output signal according to the first type of processed signal that is obtained by the first processing unit 910 and the second processed signal that is obtained by the first processing unit 910, and obtain the second output signal according to the first type of processed signal that is obtained by the first processing unit 910 and the third processed signal that is obtained by the first processing unit 910.

Optionally, in an embodiment, the receiving module 810 includes a first type of channel, a second channel, and a third channel, the at least three signals include a first type of signal received on the first channel, a second signal received on the second channel, and a third signal received on the third channel, the first type of channel includes at least two channels, the at least two channels are respectively used to receive at least two signals, any channel in the first type of channel is closer to the front than the second channel and the third channel, and any channel in the first type of channel is located between the second channel and the third channel. The processing module 840 includes a first processing unit 910 and a second processing unit 920. When the judging module 830 determines that the sound source is located in front of the terminal device, the first processing unit 910 is configured to perform the orientation enhancement processing on at least one signal in the first type of signal to obtain a first type of processed signal, perform the orientation enhancement processing on the second signal to obtain a second processed signal, and perform the orientation enhancement processing on the third signal to obtain a third processed signal, where the at least one signal in the first type of signal, the second signal, and the third signal are the target signals. The second processing unit 920 is configured to obtain the first output signal according to the second signal, the first type of processed signal that is obtained by the first processing unit 910, and the second processed signal that is obtained by the first processing unit 910, and obtain the second output signal according to the third signal, the first type of processed signal that is obtained by the first processing unit 910, and the third processed signal that is obtained by the first processing unit 910.

Optionally, in an embodiment, the receiving module 810 includes a first channel, a second channel, a third channel, a fourth channel, and a fifth channel, the at least three signals include a first signal received on the first channel, a second signal received on the second channel, a third signal received on the third channel, a fourth signal received on the fourth channel, and a fifth signal received on the fifth channel, the first channel, the second channel, or the third channel is closer to the front than the fourth channel and the fifth channel, the first channel, the second channel, and the third channel are located between the fourth channel and the fifth channel, and the front of the terminal device is divided into a first interval, a second interval, and a third interval that are adjacent. The processing module 840 includes a first processing unit 910 and a second processing unit 920. When the judging module 830 determines that the sound source is located in the first interval and the first signal is the target signal, the first processing unit 910 is configured to perform the orientation enhancement processing on the first signal to obtain a first processed signal; when the judging module 830 determines that the sound source is located in the second interval of the terminal device and the second signal is the target signal, the first processing unit 910 is configured to perform the orientation enhancement processing on the second signal to obtain a second processed signal; or when the judging module 830 determines that the sound source is located in the third interval of the terminal device and the third signal is the target signal, the first processing unit 910 is configured to perform the orientation enhancement processing on the third signal to obtain a third processed signal. When the judging module 830 determines that the sound source is located in the first interval, the second processing unit 920 is configured to obtain the first output signal according to the fourth signal and the first processed signal that is obtained by the first processing unit 910, and obtain the second output signal according to the fifth signal and the first processed signal that is obtained by the first processing unit 910; when the judging module 830 determines that the sound source is located in the second interval, the second processing unit 920 is configured to obtain the first output signal according to the fourth signal and the second processed signal that is obtained by the first processing unit 910, and obtain the second output signal according to the fifth signal and the second processed signal that is obtained by the first processing unit 910; or when the judging module 830 determines that the sound source is located in the third interval, the second processing unit 920 is specifically configured to obtain the first output signal according to the fourth signal and the third processed signal that is obtained by the first processing unit 910, and obtain the second output signal according to the fifth signal and the third processed signal that is obtained by the first processing unit 910.

Optionally, in an embodiment, the receiving module 810 includes a first channel, a second channel, a third channel, a fourth channel, and a fifth channel, the at least three signals include a first signal received on the first channel, a second signal received on the second channel, a third signal received on the third channel, a fourth signal received on the fourth channel, and a fifth signal received on the fifth channel, the first channel, the second channel, or the third channel is closer to the front than the fourth channel and the fifth channel, the first channel, the second channel, and the third channel are located between the fourth channel and the fifth channel, and the front of the terminal device is divided into a first interval, a second interval, and a third interval that are adjacent. The processing module 840 includes a first processing unit 910 and a second processing unit 920. When the judging module 830 determines that the sound source is located in the first interval and the first signal is the target signal, the first processing unit 910 is configured to perform the orientation enhancement processing on the first signal to obtain a first processed signal, perform the orientation enhancement processing on the fourth signal to obtain a fourth processed signal, and perform the orientation enhancement processing on the fifth signal to obtain a fifth processed signal; when the judging module 830 determines that the sound source is located in the second interval of the terminal device and the second signal is the target signal, the first processing unit 910 is configured to perform the orientation enhancement processing on the second signal to obtain a second processed signal, perform the orientation enhancement processing on the fourth signal to obtain a fourth processed signal, and perform the orientation enhancement processing on the fifth signal to obtain a fifth processed signal; or when the judging module 830 determines that the sound source is located in the third interval of the terminal device and the third signal is the target signal, the first processing unit 910 is configured to perform the orientation enhancement processing on the third signal to obtain a third processed signal, perform the orientation enhancement processing on the fourth signal to obtain a fourth processed signal, and perform the orientation enhancement processing on the fifth signal to obtain a fifth processed signal. When the judging module 830 determines that the sound source is located in the first interval, the second processing unit 920 is configured to obtain the first output signal according to the fourth processed signal that is obtained by the first processing unit 910 and the first processed signal that is obtained by the first processing unit 910, and obtain the second output signal according to the fifth processed signal that is obtained by the first processing unit 910 and the first processed signal that is obtained by the first processing unit 910; when the judging module 83*o* determines that the sound source is located in the second interval, the second processing unit 920 is configured to obtain the first output signal according to the fourth processed signal that is obtained by the first processing unit 910 and the second processed signal that is obtained by the first processing unit 910, and obtain the second output signal according to the fifth processed signal that is obtained by the first processing unit 910 and the second processed signal that is obtained by the first processing unit 910; or when the judging module 830 determines that the sound source is located in the third interval, the second processing unit 920 is configured to obtain the first output signal according to the fourth processed signal and the third processed signal that are obtained by the first processing unit 910, and obtain the second output signal according to the fifth processed signal that is obtained by the first processing unit 910 and the third processed signal that is obtained by the first processing unit 910.

Optionally, in an embodiment of the present invention, the processing module 840 further includes a third processing unit 930, and the third processing unit 930 is specifically configured to: when the judging module 830 determines that the sound source is located in the first interval, perform, according to a signal amplitude in each characteristic frequency band of the fourth signal and a signal amplitude in each characteristic frequency band of the fifth signal, an amplitude adjustment on each characteristic frequency band corresponding to the first processed signal obtained by the first processing unit 910, so as to obtain the first output signal and the second output signal; when the judging module 830 determines that the sound source is located in the second interval, perform, according to a signal amplitude in each characteristic frequency band of the fourth signal and a signal amplitude in each characteristic frequency band of the fifth signal, an amplitude adjustment on each characteristic frequency band corresponding to the second processed signal obtained by the first processing unit 910, so as to obtain the first output signal and the second output signal; or when the judging module 830 determines that the sound source is located in the third interval, perform, according to a signal amplitude in each characteristic frequency band of the fourth signal and a signal amplitude in each characteristic frequency band of the fifth signal, an amplitude adjustment on each characteristic frequency band corresponding to the third processed signal obtained by the first processing unit 910, so as to obtain the first output signal and the second output signal; where the first processed signal, the second processed signal, the third processed signal, the fourth signal, and the fifth signal are divided into the characteristic frequency bands in a same manner.

The terminal device in this embodiment of the present invention may implement each operation or function of a related terminal device in the embodiments in FIG. 1 to FIG. 7. Details are not described again for avoiding repetition.

In this embodiment of the present invention, a position of a sound source relative to a terminal device is determined, orientation enhancement processing is performed on a target signal emit by the sound source, and an output signal of the terminal device is obtained according to a result of the orientation enhancement processing, so that a degree of discrimination between a front characteristic frequency band and a rear characteristic frequency band of the output signal is increased. Therefore, perception of a sound image orientation of an output signal can be enhanced, and a probability of incorrectly determining a front/rear sound image.

FIG. 10 shows a schematic block diagram of a terminal device according to an embodiment of the present invention. As shown in FIG. 10, the terminal device 1000 includes a receiver 1100, a bus system 1200, a processor 1300, and a transmitter 1400. The receiver 1100 and the transmitter 1400 are connected to the processor 1300 by using the bus system 1200. The receiver 1100 includes at least three channels located in different positions of the terminal device, and the at least three channels are used to receive at least three signals emit by a same sound source, where the at least three signals are in a one-to-one correspondence to the channels. The processor 1300 is configured to: determine, according to three signals in the at least three signals, a signal delay difference between every two of the three signals, where a position of the sound source relative to the terminal device can be determined according to the signal delay difference; determine, according to the signal delay difference, the position of the sound source relative to the terminal device; and when the sound source is located in front of the terminal device, perform orientation enhancement processing on a target signal in the at least three signals, and obtain a first output signal and a second output signal of the terminal device according to a result of the orientation enhancement processing, where the orientation enhancement processing is used to increase a degree of discrimination between a front characteristic frequency band and a rear characteristic frequency band of the target signal. The transmitter 1400 is configured to send the first output signal and the second output signal.

In this embodiment of the present invention, a position of a sound source relative to a terminal device is determined, orientation enhancement processing is performed on a target signal emit by the sound source, and an output signal of the terminal device is obtained according to a result of the orientation enhancement processing, so that a degree of discrimination between a front characteristic frequency band and a rear characteristic frequency band of the output signal is increased. Therefore, perception of a sound image orientation of an output signal can be enhanced, and a probability of incorrectly determining a front/rear sound image.

It should be understood that in this embodiment of the present invention, the processor 1300 may be a central processing unit (CPU), or the processor 1300 may be another general purpose processor, a digital signal processor (DSP), an application-specific integrated circuit (ASIC), a field programmable gate array (FPGA), or another programmable logic device, discrete gate or transistor logic device, discrete hardware component, or the like. The general purpose processor may be a microprocessor. Alternatively, the processor may be any conventional processor or the like.

The bus system 1200 may further include a power bus, a control bus, a status signal bus, and the like, in addition to a data bus. However, for clear description, various types of buses in the figure are marked as the bus system 1200.

In an implementation process, each step of the foregoing methods may be completed by using an integrated logic circuit of hardware in the processor 1300 or an instruction in a form of software. Steps of the methods disclosed with reference to the embodiments of the present invention may be directly executed and completed by a hardware processor, or may be executed and completed by using a combination of hardware in the processor and software modules. Details are not described again herein for avoiding repetition.

Optionally, in an embodiment, the processor 1300 is further configured to perform enhancement processing on the front characteristic frequency band of the target signal, and/or perform suppression processing on the rear characteristic frequency band of the target signal.

Optionally, in an embodiment, the sound signals collected by the terminal device 1000 include a first signal received on a first channel, a second signal received on a second channel, and a third signal received on a third channel, the first channel is closer to the front than the second channel and the third channel, and the first channel is located between the second channel and the third channel. When the sound source is located in front of the terminal device, the processor 1300 is specifically configured to perform the orientation enhancement processing on the first signal to obtain a first processed signal. That the processor 1300 is further configured to obtain a first output signal and a second output signal of the terminal device according to a result of the orientation enhancement processing includes: obtaining the first output signal according to the first processed signal and the second signal; and obtaining the second output signal according to the first processed signal and the third signal.

Optionally, in an embodiment, the sound signals received by the receiver 1100 include a first signal received on a first channel, a second signal received on a second channel, and a third signal received on a third channel, the first channel is closer to the front than the second channel and the third channel, and the first channel is located between the second channel and the third channel. When determining that the sound source is located in front, the processor 1300 is specifically configured to perform the orientation enhancement processing on the first signal to obtain a first processed signal, perform the orientation enhancement processing on the second signal to obtain a second processed signal, and perform the orientation enhancement processing on the third signal to obtain a third processed signal. The processor 1300 is further configured to obtain the first output signal according to the first processed signal and the second processed signal, and obtain the second output signal according to the first processed signal and the third processed signal.

Optionally, in an embodiment, the sound signals received by the receiver 1100 include a first signal received on a first channel, a second signal received on a second channel, and a third signal received on a third channel, the first channel is closer to the front than the second channel and the third channel, and the first channel is located between the second channel and the third channel. When determining that the sound source is located in front, the processor 1300 is specifically configured to perform the orientation enhancement processing on the first signal to obtain a first processed signal, perform the orientation enhancement processing on the second signal to obtain a second processed signal, and perform the orientation enhancement processing on the third signal to obtain a third processed signal. The processor 1300 is further configured to obtain the first output signal according to the first processed signal, the second processed signal, and the second signal, and obtain the second output signal according to the first processed signal, the third processed signal, and the third signal.

Optionally, in an embodiment, the processor 1300 is further configured to perform, according to a signal amplitude in each characteristic frequency band of the second signal and a signal amplitude in each characteristic frequency band of the third signal, an amplitude adjustment on each characteristic frequency band corresponding to the first processed signal, so as to obtain the first output signal and the second output signal, where the first processed signal, the second signal, and the third signal are divided into the characteristic frequency bands in a same manner.

Optionally, in an embodiment of the present invention, the signals received by the receiver 1100 include a first type of signal received on a first type of channel, a second signal received on a second channel, and a third signal received on a third channel, the first type of channel includes at least two channels, the at least two channels are respectively used to receive at least two signals, any channel in the first type of channel is closer to the front than the second channel and the third channel, and the first type of channel is located between the second channel and the third channel. When determining that the sound source is located in front, the processor 1300 is configured to perform the orientation enhancement processing on at least one signal in the first type of signal to obtain a first type of processed signal. The processor 1300 is further configured to obtain the first output signal according to the first type of processed signal and the second signal, and obtain the second output signal according to the first type of processed signal and the third signal.

Optionally, in an embodiment of the present invention, the signals received by the receiver 1100 include a first type of signal received on a first type of channel, a second signal received on a second channel, and a third signal received on a third channel, the first type of channel includes at least two channels, the at least two channels are respectively used to receive at least two signals, any channel in the first type of channel is closer to the front than the second channel and the third channel, and the first type of channel is located between the second channel and the third channel. When determining that the sound source is located in front, the processor 1300 is configured to perform the orientation enhancement processing on at least one signal in the first type of signal to obtain a first type of processed signal, perform the orientation enhancement processing on the second signal to obtain a second processed signal, and perform the orientation enhancement processing on the third signal to obtain a third processed signal. The processor 1300 is further configured to obtain the first output signal according to the first type of processed signal and the second processed signal, and obtain the second output signal according to the first type of processed signal and the third processed signal.

Optionally, in an embodiment of the present invention, the signals received by the receiver 1100 include a first type of signal received on a first type of channel, a second signal received on a second channel, and a third signal received on a third channel, the first type of channel includes at least two channels, the at least two channels are respectively used to receive at least two signals, and any channel in the first type of channel is closer to the front than the second channel and the third channel. When determining that the sound source is located in front, the processor 1300 is configured to perform the orientation enhancement processing on at least one signal in the first type of signal to obtain a first type of processed signal, perform the orientation enhancement processing on the second signal to obtain a second processed signal, and perform the orientation enhancement processing on the third signal to obtain a third processed signal. The processor 1300 is further configured to obtain the first output signal according to the first type of processed signal, the second processed signal, and the second signal, and obtain the second output signal according to the first type of processed signal, the third processed signal, and the third signal.

Optionally, in an embodiment of the present invention, the signals received by the receiver 1100 include a first signal received on a first channel, a second signal received on a second channel, a third signal received on a third channel, a fourth signal received on a fourth channel, and a fifth signal received on a fifth channel, the first channel, the second channel, or the third channel is closer to the front than the fourth channel and the fifth channel, the first channel, the second channel, and the third channel are located between the fourth channel and the fifth channel, and the front of the terminal device is divided into a first interval, a second interval, and a third interval that are adjacent. When determining that the sound source is located in front, the processor 1300 is configured to: when the sound source is located in the first interval and the first signal is the target signal, perform the orientation enhancement processing on the first signal to obtain a first processed signal; when the sound source is located in the second interval of the terminal device and the second signal is the target signal, perform the orientation enhancement processing on the second signal to obtain a second processed signal; or when the sound source is located in the third interval of the terminal device and the third signal is the target signal, perform the orientation enhancement processing on the third signal to obtain a third processed signal. When determining that the sound source is located in front, the processor 1300 is further configured to: when the sound source is located in the first interval, obtain the first output signal according to the first processed signal and the fourth signal, and obtain the second output signal according to the first processed signal and the fifth signal; when the sound source is located in the second interval, obtain the first output signal according to the second processed signal and the fourth signal, and obtain the second output signal according to the second processed signal and the fifth signal; or when the sound source is located in the third interval, obtain the first output signal according to the third processed signal and the fourth signal, and obtain the second output signal according to the third processed signal and the fifth signal.

Optionally, in an embodiment of the present invention, the at least three signals received by the receiver 1100 include a first signal received on a first channel, a second signal received on a second channel, a third signal received on a third channel, a fourth signal received on a fourth channel, and a fifth signal received on a fifth channel, the first channel, the second channel, or the third channel is closer to the front than the fourth channel and the fifth channel, the first channel, the second channel, and the third channel are located between the fourth channel and the fifth channel, and the front of the terminal device is divided into a first interval, a second interval, and a third interval that are adjacent. When determining that the sound source is located in front, the processor 1300 is configured to: when the sound source is located in the first interval, and all the first signal, the fourth signal, and the fifth signal are the target signals, perform the orientation enhancement processing on the first signal to obtain a first processed signal, perform the orientation enhancement processing on the fourth signal to obtain a fourth processed signal, and perform the orientation enhancement processing on the fifth signal to obtain a fifth processed signal; when the sound source is located in the second interval, and all the second signal, the fourth signal, and the fifth signal are the target signals, perform the orientation enhancement processing on the second signal to obtain a second processed signal, perform the orientation enhancement processing on the fourth signal to obtain a fourth processed signal, and perform the orientation enhancement processing on the fifth signal to obtain a fifth processed signal; or when the sound source is located in the third interval, and all the third signal, the fourth signal, and the fifth signal are the target signals, perform the orientation enhancement processing on the third signal to obtain a third processed signal, perform the orientation enhancement processing on the fourth signal to obtain a fourth processed signal, and perform the orientation enhancement processing on the fifth signal to obtain a fifth processed signal. The processor 1300 is further configured to: when the sound source is located in the first interval, obtain the first output signal according to the fourth processed signal and the first processed signal, and obtain the second output signal according to the fifth processed signal and the first processed signal; when the sound source is located in the second interval, obtain the first output signal according to the fourth processed signal and the second processed signal, and obtain the second output signal according to the fifth processed signal and the second processed signal; or when the sound source is located in the third interval, obtain the first output signal according to the fourth processed signal and the third processed signal, and obtain the second output signal according to the fifth processed signal and the third processed signal.

Optionally, in an embodiment of the present invention, the processor 1300 is further configured to: when the sound source is located in the first interval, perform, according to a signal amplitude in each characteristic frequency band of the fourth signal and a signal amplitude in each characteristic frequency band of the fifth signal, an amplitude adjustment on each characteristic frequency band corresponding to the first processed signal, so as to obtain the first output signal and the second output signal; when the sound source is located in the second interval, perform, according to a signal amplitude in each characteristic frequency band of the fourth signal and a signal amplitude in each characteristic frequency band of the fifth signal, an amplitude adjustment on each characteristic frequency band corresponding to the second processed signal, so as to obtain the first output signal and the second output signal; or when the sound source is located in the third interval, perform, according to a signal amplitude in each characteristic frequency band of the fourth signal and a signal amplitude in each characteristic frequency band of the fifth signal, an amplitude adjustment on each characteristic frequency band corresponding to the third processed signal, so as to obtain the first output signal and the second output signal; where the first processed signal, the second processed signal, the third processed signal, the fourth signal, and the fifth signal are divided into the characteristic frequency bands in a same manner.

In this embodiment of the present invention, a position of a sound source relative to a terminal device is determined, orientation enhancement processing is performed on a target signal emit by the sound source, and an output signal of the terminal device is obtained according to a result of the orientation enhancement processing, so that a degree of discrimination between a front characteristic frequency band and a rear characteristic frequency band of the output signal is increased. Therefore, perception of a sound image orientation of an output signal can be enhanced, and a probability of incorrectly determining a front sound image as a rear sound image is reduced.

A person of ordinary skill in the art may be aware that, in combination with the examples described in the embodiments disclosed in this specification, method steps and units may be implemented by electronic hardware, computer software, or a combination thereof. To clearly describe the interchangeability between the hardware and the software, the foregoing has generally described steps and compositions of each embodiment according to functions. Whether the functions are performed by hardware or software depends on particular applications and design constraint conditions of the technical solutions. A person of ordinary skill in the art may use different methods to implement the described functions for each particular application, but it should not be considered that the implementation goes beyond the scope of the present invention.

Methods or steps described in the embodiments disclosed in this specification may be implemented by hardware, a software program executed by a processor, or a combination thereof. The software program may reside in a random access memory (RAM), a memory, a read-only memory (ROM), an electrically programmable ROM, an electrically erasable programmable ROM, a register, a hard disk, a removable disk, a CD-ROM, or any other form of storage medium known in the art.

The present invention is described in detail with reference to the accompany drawings and in combination with the exemplary embodiments, but the present invention is not limited to this. Various equivalent modifications or replacements can be made to the embodiments of the present invention by a person of ordinary skill in the art without departing from the spirit and essence of the present invention, and the modifications or replacements shall fall within the scope of the present invention.

What is claimed is:

1. A method, comprising:

receiving, using channels located in different positions of a terminal device, at least three signals emitted by a same sound source, wherein the at least three signals are in a one-to-one correspondence to the channels;

determining, according to three signals in the at least three signals, a signal delay difference between every two of the three signals, wherein the signal delay difference is used to determine a position of the sound source relative to the terminal device;

determining, according to the signal delay differences, the position of the sound source relative to the terminal device;

when the sound source is located in front of the terminal device, performing orientation enhancement processing on a target signal in the at least three signals, and obtaining a first output signal and a second output signal of the terminal device according to a result of the orientation enhancement processing, wherein the orientation enhancement processing increases a degree of discrimination between a first characteristic frequency band that corresponds to the front of the terminal device and a second characteristic frequency band that corresponds to a rear of the terminal device; and when the sound source is located in a position that is different than the front of the terminal device, using a first of the at least three signals as the first output signal of the terminal device and using a second of the at least three signals as the second output signal of the terminal device.

2. The method according to claim 1, wherein the at least three signals comprise a first signal received on a first channel, a second signal received on a second channel, and a third signal received on a third channel, the first channel is closer to the front than the second channel and the third channel, and the first channel is located between the second channel and the third channel;

wherein performing orientation enhancement processing on the target signal in the at least three signals comprises, when the first signal is the target signal, performing the orientation enhancement processing on the first signal to obtain a first processed signal; and wherein obtaining a first output signal and a second output signal of the terminal device according to a result of the orientation enhancement processing comprises:

obtaining the first output signal according to the first processed signal and the second signal; and obtaining the second output signal according to the first processed signal and the third signal.

3. The method according to claim 2, further comprising:

performing, according to a signal amplitude in each characteristic frequency band of the second signal and a signal amplitude in each characteristic frequency band of the third signal, an amplitude adjustment on each characteristic frequency band corresponding to the first processed signal, so as to obtain the first output signal and the second output signal, wherein the first processed signal, the second signal, and the third signal are divided into the characteristic frequency bands in a same manner.

4. The method according to claim 1, wherein the at least three signals comprise a first signal received on a first channel, a second signal received on a second channel, and a third signal received on a third channel, the first channel is closer to the front than the second channel and the third channel, and the first channel is located between the second channel and the third channel;

wherein performing orientation enhancement processing on the target signal in the at least three signals comprises, when all of the first signal, the second signal, and the third signal are the target signals, performing the orientation enhancement processing on the first signal to obtain a first processed signal, performing the orientation enhancement processing on the second signal to obtain a second processed signal, and performing the orientation enhancement processing on the third signal to obtain a third processed signal; and wherein obtaining the first output signal and the second output signal of the terminal device according to the result of the orientation enhancement processing comprises:

obtaining the first output signal according to the first processed signal and the second processed signal; and obtaining the second output signal according to the first processed signal and the third processed signal.

5. The method according to claim 1, wherein the at least three signals comprise a first signal received on a first channel, a second signal received on a second channel, and a third signal received on a third channel, the first channel is closer to the front than the second channel and the third channel, and the first channel is located between the second channel and the third channel;

wherein performing orientation enhancement processing on the target signal in the at least three signals comprises, when all the first signal, the second signal, and the third signal are the target signals, performing the orientation enhancement processing on the first signal to obtain a first processed signal, performing the orientation enhancement processing on the second signal to obtain a second processed signal, and performing the orientation enhancement processing on the third signal to obtain a third processed signal; and wherein obtaining the first output signal and the second output signal of the terminal device according to the result of the orientation enhancement processing comprises:

obtaining the first output signal according to the first processed signal, the second processed signal, and the second signal; and obtaining the second output signal according to the first processed signal, the third processed signal, and the third signal.

6. The method according to claim 1, wherein the at least three signals comprise a first type of signal received on a first type of channel, a second signal received on a second channel, and a third signal received on a third channel, the first type of channel comprises at least two channels, the at least two channels are respectively used to receive at least two signals, any channel in the first type of channel is closer to the front than the second channel and the third channel, and any channel in the first type of channel is located between the second channel and the third channel;

wherein performing orientation enhancement processing on the target signal in the at least three signals comprises:

when at least one signal in the first type of signal is the target signal, performing the orientation enhancement processing on the at least one signal in the first type of signal to obtain a first type of processed signal; and wherein obtaining the first output signal and the second output signal of the terminal device according to the result of the orientation enhancement processing comprises:

obtaining the first output signal according to the first type of processed signal and the second signal; and obtaining the second output signal according to the first type of processed signal and the third signal.

7. The method according to claim 1, wherein the at least three signals comprise a first type of signal received on a first type of channel, a second signal received on a second channel, and a third signal received on a third channel, the first type of channel comprises at least two channels, the at least two channels are respectively used to receive at least two signals, any channel in the first type of channel is closer to the front than the second channel and the third channel, and any channel in the first type of channel is located between the second channel and the third channel;

wherein performing orientation enhancement processing on the target signal in the at least three signals comprises:

when at least one signal in the first type of signal, the second signal, and the third signal are the target signals, performing the orientation enhancement processing on the at least one signal in the first type of signal to obtain a first type of processed signal, performing the orientation enhancement processing on the second signal to obtain a second processed signal, and performing the orientation enhancement processing on the third signal to obtain a third processed signal; and wherein obtaining the first output signal and the second output signal of the terminal device according to the result of the orientation enhancement processing comprises:

obtaining the first output signal according to the first type of processed signal and the second processed signal; and obtaining the second output signal according to the first type of processed signal and the third processed signal.

8. The method according to claim 1, wherein the at least three signals comprise a first type of signal received on a first type of channel, a second signal received on a second channel, and a third signal received on a third channel, the first type of channel comprises at least two channels, the at least two channels are respectively used to receive at least two signals, any channel in the first type of channel is closer to the front than the second channel and the third channel, and any channel in the first type of channel is located between the second channel and the third channel;

wherein performing orientation enhancement processing on the target signal in the at least three signals comprises:

when at least one signal in the first type of signal, the second signal, and the third signal are the target signals, performing the orientation enhancement processing on the at least one signal in the first type of signal to obtain a first type of processed signal, performing the orientation enhancement processing on the second signal to obtain a second processed signal, and performing the orientation enhancement processing on the third signal to obtain a third processed signal; and wherein obtaining the first output signal and a second output signal of the terminal device according to the result of the orientation enhancement processing comprises:

obtaining the first output signal according to the first type of processed signal, the second processed signal, and the second signal; and obtaining the second output signal according to the first type of processed signal, the third processed signal, and the third signal.

9. The method according to claim 1, wherein the at least three signals comprise a first signal received on a first channel, a second signal received on a second channel, a third signal received on a third channel, a fourth signal received on a fourth channel, and a fifth signal received on a fifth channel, wherein the first channel, the second channel, or the third channel is closer to the front than the fourth channel and the fifth channel, wherein the first channel, the second channel, and the third channel are located between the fourth channel and the fifth channel, and the front of the terminal device is divided into a first interval, a second interval, and a third interval that are adjacent;

wherein performing orientation enhancement processing on the target signal in the at least three signals comprises:

when the sound source is located in the first interval and the first signal is the target signal, performing the orientation enhancement processing on the first signal to obtain a first processed signal;

when the sound source is located in the second interval and the second signal is the target signal, performing the orientation enhancement processing on the second signal to obtain a second processed signal; or when the sound source is located in the third interval and the third signal is the target signal, performing the orientation enhancement processing on the third signal to obtain a third processed signal; and wherein obtaining the first output signal and the second output signal of the terminal device according to a result of the orientation enhancement processing comprises:

when the sound source is located in the first interval, obtaining the first output signal according to the first processed signal and the fourth signal, and obtaining the second output signal according to the first processed signal and the fifth signal;

when the sound source is located in the second interval, obtaining the first output signal according to the second processed signal and the fourth signal, and obtaining the second output signal according to the second processed signal and the fifth signal; or when the sound source is located in the third interval, obtaining the first output signal according to the third processed signal and the fourth signal, and obtaining the second output signal according to the third processed signal and the fifth signal.

10. The method according to claim 9, further comprising:

when the sound source is located in the first interval, performing, according to a signal amplitude in each characteristic frequency band of the fourth signal and a signal amplitude in each characteristic frequency band of the fifth signal, an amplitude adjustment on each characteristic frequency band corresponding to the first processed signal, so as to obtain the first output signal and the second output signal;

when the sound source is located in the second interval, performing, according to a signal amplitude in each characteristic frequency band of the fourth signal and a signal amplitude in each characteristic frequency band of the fifth signal, an amplitude adjustment on each characteristic frequency band corresponding to the second processed signal, so as to obtain the first output signal and the second output signal; or when the sound source is located in the third interval, performing, according to a signal amplitude in each characteristic frequency band of the fourth signal and a signal amplitude in each characteristic frequency band of the fifth signal, an amplitude adjustment on each characteristic frequency band corresponding to the third processed signal, so as to obtain the first output signal and the second output signal;

wherein the first processed signal, the second processed signal, the third processed signal, the fourth signal, and the fifth signal are divided into the characteristic frequency bands in a same manner.

11. The method according to claim 1, wherein the at least three signals comprise a first signal received on a first channel, a second signal received on a second channel, a third signal received on a third channel, a fourth signal received on a fourth channel, and a fifth signal received on a fifth channel, wherein the first channel, the second channel, or the third channel is closer to the front than the fourth channel and the fifth channel, wherein the first channel, the second channel, and the third channel are located between the fourth channel and the fifth channel, and the front of the terminal device is divided into a first interval, a second interval, and a third interval that are adjacent;

wherein performing orientation enhancement processing on the target signal in the at least three signals comprises:

when the sound source is located in the first interval, and all the first signal, the fourth signal, and the fifth signal are the target signals, performing the orientation enhancement processing on the first signal to obtain a first processed signal, performing the orientation enhancement processing on the fourth signal to obtain a fourth processed signal, and performing the orientation enhancement processing on the fifth signal to obtain a fifth processed signal;

when the sound source is located in the second interval, and all the second signal, the fourth signal, and the fifth signal are the target signals, performing the orientation enhancement processing on the second signal to obtain a second processed signal, performing the orientation enhancement processing on the fourth signal to obtain a fourth processed signal, and performing the orientation enhancement processing on the fifth signal to obtain a fifth processed signal; or when the sound source is located in the third interval, and all the third signal, the fourth signal, and the fifth signal are the target signals, performing the orientation enhancement processing on the third signal to obtain a third processed signal, performing the orientation enhancement processing on the fourth signal to obtain a fourth processed signal, and performing the orientation enhancement processing on the fifth signal to obtain a fifth processed signal; and wherein obtaining a first output signal and a second output signal of the terminal device according to a result of the orientation enhancement processing comprises:

when the sound source is located in the first interval, obtaining the first output signal according to the fourth processed signal and the first processed signal, and obtaining the second output signal according to the fifth processed signal and the first processed signal;

when the sound source is located in the second interval, obtaining the first output signal according to the fourth processed signal and the second processed signal, and obtaining the second output signal according to the fifth processed signal and the second processed signal; or when the sound source is located in the third interval, obtaining the first output signal according to the fourth processed signal and the third processed signal, and obtaining the second output signal according to the fifth processed signal and the third processed signal.

12. A terminal device, comprising:

a receiver, comprising at least three receiving channels located in different positions of the terminal device, and the at least three receiving channels are used to receive at least three signals emitted by a same sound source, wherein the at least three signals are in a one-to-one correspondence to the channels, wherein a first receiving channel of the at least three receiving channels is closest to a front of the terminal device, wherein a second receiving channel of the at least three receiving channels is closest to a left of the terminal device, wherein a third receiving channel of the at least three receiving channels is closest to a right of the terminal device, and wherein the first receiving channel is disposed between the second receiving channel and the third receiving channel, and wherein the first receiving channel is configured to receive a first signal of the at least three signals, the second receiving channel is configured to receive a second signal of the at least three signals, and the third receiving channel is configured to receive a third signal of the at least three signals;

a processor; and a non-transitory computer-readable storage medium storing a program to be executed by the processor, the program including instructions for:

determining, according to three signals in the at least three signals, a signal delay difference between every two of the three signals, wherein a position of the sound source relative to the terminal device can be determined according to the signal delay difference;

determining, according to the signal delay differences, the position of the sound source relative to the terminal device; and when it is determined that the sound source is located in front of the terminal device, performing orientation enhancement processing on the first signal in the at least three signals to obtain a first processed signal, and obtaining a first output signal according to a result of the orientation enhancement processing by processing the second signal using the first processed signal, and obtaining a second output signal by processing the third signal using the first processed signal, wherein the orientation enhancement processing is used to increase a degree of discrimination between a front characteristic frequency band of the first signal that corresponds to the front of the terminal device and a rear characteristic frequency band of the first signal that corresponds to a rear of the terminal device.

13. The terminal device according to claim 12, wherein the program further includes instructions for performing an amplitude adjustment on each characteristic frequency band of the first signal to obtain the first processed signal, obtaining the first output signal by combining the first processed signal and the second signal, and obtaining the second output signal by combining the third signal and the first processed signal, wherein the first processed signal, the second signal, and the third signal are each divided into the characteristic frequency bands in a same manner.

14. The terminal device according to claim 12, wherein the program further includes instructions for:

when the sound source is located in a position that is different than the front of the terminal device, using the second signal of the at least three signals as the first output signal of the terminal device and using the third signal of the at least three signals as the second output signal of the terminal device.

15. The terminal device according to claim 12, wherein the first signal is divided into five characteristic frequency bands, and wherein three of the five characteristic frequency bands correspond to the front of the terminal device, and wherein two of the five characteristic frequency bands correspond to the rear of the terminal device.

16. The terminal device according to claim 12, wherein the first signal is divided into five characteristic frequency bands, and wherein performing orientation enhancement processing on the first signal in the at least three signals to obtain a first processed signal comprises respectively performing an amplitude adjustment on each of the five characteristic frequency bands, wherein after the amplitude adjustment a plurality of characteristic frequency bands that correspond to the front of the terminal device are increased in amplitude and a plurality of characteristic frequency bands that correspond to the rear of the terminal device are decreased in amplitude.

* * * * *